US007994717B2

(12) United States Patent
Okishiro et al.

(10) Patent No.: US 7,994,717 B2
(45) Date of Patent: Aug. 9, 2011

(54) PLASMA DISPLAY PANEL AND PLASMA DISPLAY APPARATUS USING THE SAME

(75) Inventors: Kenji Okishiro, Kawasaki (JP); Keizo Suzuki, Kodaira (JP); Tatsuya Miyake, Tokorozawa (JP); Choichiro Okazaki, Kodaira (JP)

(73) Assignee: Hitachi, Ltd., Tokyo (JP)

( * ) Notice: Subject to any disclaimer, the term of this patent is extended or adjusted under 35 U.S.C. 154(b) by 136 days.

(21) Appl. No.: 12/518,174

(22) PCT Filed: Dec. 12, 2006

(86) PCT No.: PCT/JP2006/324736

§ 371 (c)(1),
(2), (4) Date: Jun. 8, 2009

(87) PCT Pub. No.: WO2008/072309

PCT Pub. Date: Jun. 19, 2008

(65) Prior Publication Data

US 2010/0090582 A1 Apr. 15, 2010

(51) Int. Cl.
*H01J 1/62* (2006.01)

(52) U.S. Cl. ..... 313/582; 313/586

(58) Field of Classification Search ..... 313/582, 313/584, 586, 587

See application file for complete search history.

(56) References Cited

U.S. PATENT DOCUMENTS

| | | | |
|---|---|---|---|
| 5,939,826 | A | 8/1999 | Ohsawa et al. |
| 6,100,633 | A | 8/2000 | Okumura et al. |
| 6,333,600 | B1 | 12/2001 | Mizobata |
| 2002/0089284 | A1 | 7/2002 | Hayashi |
| 2007/0001602 | A1 | 1/2007 | Miyake et al. |

FOREIGN PATENT DOCUMENTS

| | | | |
|---|---|---|---|
| JP | 2-242548 | A | 9/1990 |
| JP | 8-138559 | A | 5/1996 |
| JP | 10-154466 | A | 6/1998 |
| JP | 11-162357 | A | 6/1999 |
| JP | 11-185642 | A | 7/1999 |
| JP | 11-204044 | A | 7/1999 |
| JP | 2000-11885 | A | 1/2000 |
| JP | 2001-185036 | A | 7/2001 |
| JP | 2002-124193 | A | 4/2002 |
| JP | 2002-208355 | A | 7/2002 |
| JP | 2004-22180 | A | 1/2004 |
| JP | 2006-237021 | A | 9/2006 |
| JP | 2007-12342 | A | 1/2007 |

OTHER PUBLICATIONS

U.S. Appl. No. 12/222,774, filed Aug. 15, 2008.

*Primary Examiner* — Vip Patel
(74) *Attorney, Agent, or Firm* — Mattingly & Malur, PC

(57) ABSTRACT

A high-luminance plasma display panel has a plurality of discharge cells including a phosphor film emitting visible rays by excitation caused by ultraviolet light generated by the discharge of a discharge gas. The phosphor film has at least two layers of a phosphor layer and a reflecting layer, and the phosphor layer is arranged closer to the discharge space side than the reflecting layer. A film thickness Wt of the phosphor film is 40 μm or less, and a film thickness Wp of the phosphor layer, a particle diameter dp of a phosphor that is at least a part of components of the phosphor layer, a film thickness Wr of the reflecting layer, and a particle diameter dr of a reflecting material that is at least a part of components of the reflecting layer satisfy $2dp \leqq Wp \leqq 5dp$ and $2dr \leqq Wr \leqq Wt - Wp$.

20 Claims, 12 Drawing Sheets

ENLARGED VIEW OF PORTION A

ENLARGED VIEW OF PORTION A

PLASMA DISPLAY PANEL AND PLASMA DISPLAY APPARATUS USING THE SAME

TECHNICAL FIELD

The present invention relates to a plasma display panel (hereinafter, also called "plasma panel") used in a flat-screen television set and the like and a plasma display apparatus (hereinafter, also called "plasma display") using the same, and also relates to a structure for realizing high luminance. Further, the present invention relates to a structure for achieving both high luminance and high contrast.

BACKGROUND ART

A plasma display apparatus is utilized as a large-screen flat display for various applications such as a television set and a billboard. Currently, development of the plasma display apparatus has been advanced toward higher performance, especially, higher luminance or higher efficiency in order to achieve further improvement of display characteristics.

In recent years, in the market surrounding such a plasma display apparatus, performance competition including other flat displays such as a liquid crystal display is very keen. The plasma display apparatus is especially required to have higher luminance (higher efficiency) and higher contrast, and it is also required to be full HD (High Definition) compliant (higher definition) for the upcoming high-resolution digital television broadcasting.

Japanese Patent Document 1 (Patent Application Laid-Open Publication No. H11-204044), in order to obtain a plasma display apparatus having high light emitting efficiency and luminance with respect to a size of a discharge cell, discloses a technique in which a phosphor layer is disposed over barrier ribs and a back plate plane and a visible ray reflecting layer is disposed between the back plate and the phosphor layer so that transmittance of the phosphor layer to visible rays is averagely higher on the visible ray reflecting layer than on the barrier rib.

Patent Document 2 (Japanese Patent Application Laid-Open Publication No. 2000-11885), in order to obtain a plasma display apparatus having improved luminance as well as preventing poor withstand voltage and also its luminance becomes even for red, green, and blue, discloses a technique in which a reflecting layer containing a white color material (for example, $TiO_2$) is formed on side wall surfaces of barrier ribs and a bottom surface positioned between barrier ribs in contact with a phosphor layer on a rear substrate.

Patent Document 1: Patent Application Laid-Open Publication No. H11-204044

Patent Document 2: Japanese Patent Application Laid-Open Publication No. 2000-11885

DISCLOSURE OF THE INVENTION

Problems to be Solved by the Invention

A first problem to be solved by the present invention lies in an achievement of higher luminance (higher efficiency) for a plasma display panel. Also, an achievement of higher luminance in the full HD compliance (higher definition) for the future high-resolution digital television broadcasting. A second problem is to achieve higher contrast for these high-luminance plasma panels. Accordingly, a plasma panel capable of achieving higher luminance and higher contrast can be realized.

Achievement of higher luminance which is the first problem has been studied in various ways for some time, and various means have been proposed.

For example, like Patent Document 1 (Japanese Patent Application Laid-Open Publication No. H11-204044) and Patent Document 2 (Japanese Patent Application Laid-Open Publication No. 2000-011885), means to achieve higher luminance by forming a layer having a high reflection coefficient between a phosphor film and a phosphor-layer holding portion so that visible rays from phosphors are efficiently emitted to the front substrate side.

However, in these proposed techniques, for example, a relationship of thicknesses of the phosphor layer and the reflecting layer is not clarified, and a condition which lowers luminance is included depending on thickness conditions. To achieve higher luminance, it is necessary to clarify a relationship between optical characteristics of the phosphor layer composing the phosphor film and the reflecting layer, and also necessary to clarify a relationship between thickness and particle diameter influencing these characteristics. That is because higher luminance (higher efficiency) can be achieved only by clarifying these relationships and optimizing respective conditions.

In addition, achievement of higher luminance of the full HD compliant plasma display panel (high definition plasma panel) is also an important problem. A size of the discharge cell is small in the full HD compliant plasma display panel. For example, in the case of a discharge cell in a 42-inch XGA plasma display panel (Extended Graphics Array), the size in the horizontal direction on the screen is about 300 μm, while it is about 160 μm in the case of full HD. Like this, if the cell size is reduced, a discharge space becomes small, and a lowering of emission efficiency (lowering of luminance) is expected as a result.

Accordingly, for the future, a technique for achieving high luminance targeting the full HD and high definition is also an essential technique to be developed. Also in this case, it is considered that high luminance can be realized by utilizing a high reflection material in a dielectric and a barrier rib configuring a phosphor holding portion. However, it is necessary to clarify a relationship between a film thickness of a phosphor and reflection characteristics of the phosphor holding portion and a cell size (a size of a discharge space).

A second problem is to achieve high contrast of a high-luminance plasma panel. The term "contrast" here means bright-room contrast. To the plasma display, outside light enters and luminance in the black color display becomes high due to light reflected by members such as a phosphor film configuring the plasma display. Thereby, lowering of contrast occurs.

An object of the present invention is to clarify relationships among a film thickness of a phosphor film configuring a plasma display panel, a film thickness of a reflecting layer, and a diameter of particles configuring each film to define conditions which can realize high efficiency, thereby providing a high-luminance plasma display panel and a plasma display apparatus using the same. Another object is to achieve both high luminance and high contrast to provide a high-performance plasma display panel and a plasma display apparatus using the same.

The above and other objects and novel characteristics of the present invention will be apparent from the description of this specification and the accompanying drawings.

Means for Solving the Problems

The typical ones of the inventions disclosed in this application will be briefly described as follows.

A plasma display panel according to the present invention comprises at least a plurality of discharge cells as part of components. The discharge cell includes: electrodes for applying voltage to the discharge cell; a discharge gas for forming discharge, a discharge space where the discharge is formed; and a phosphor film emitting visible rays according to excitation caused by ultraviolet light generated by the discharge, as at least part of its components. The phosphor film includes at least two layers of a phosphor layer and a reflecting layer, the phosphor layer being disposed closer to the discharge space side rather than the reflecting layer. A thickness of the phosphor film, namely, a phosphor film thickness Wt is 40 μm or less; and a thickness of the phosphor layer, namely, a phosphor layer thickness (film thickness) Wp, a particle diameter of phosphor that is at least a part of components of the phosphor layer, namely, a phosphor particle diameter dp, a thickness of the reflecting layer, namely, a reflecting layer thickness (film thickness) Wr, and a particle diameter of a reflecting material that is at least a part of components of the reflecting layer, namely, a reflecting material particle diameter dr satisfy $2dp \leqq Wp \leqq 5dp$ and $2dr\ Wr \leqq Wt-Wp$.

A plasma display panel according to the present invention comprises at least a plurality of discharge cells as part of its components. The discharge cell includes: electrodes for applying voltage to the discharge cell; a discharge gas for forming discharge; a discharge space where the discharge is formed; and a phosphor film emitting visible rays according to excitation caused by ultraviolet light generated by the discharge, as at least part of its components. And, the plasma display panel comprises a phosphor film holding portion holding the phosphor film. A thickness of the phosphor film, namely, phosphor film thickness Wt, a particle diameter of phosphor which is at least a part of components of the phosphor layer, namely, a phosphor particle diameter dp, and a reflection coefficient βs of at least a part of a surface holding the phosphor film of the phosphor film holding portion satisfy $2dp \leqq Wt \leqq 5dp$ and $0.70 \leqq \beta s$.

Further, a plasma display apparatus according to the present invention comprises at least a plasma display panel and a driving unit for applying voltage to the plasma display panel as part of its components. The plasma display panel includes at least a plurality of discharge cells as part of its components. The discharge cell includes: electrodes for applying voltage to the discharge cell; a discharge gas forming discharge; a discharge space where the discharge is formed; and a phosphor film emitting visible rays according to excitation caused by ultraviolet light generated by the discharge as at least part of its components. The phosphor film includes at least two layers of a phosphor layer and a reflecting layer, the phosphor layer being disposed closer to the side of the discharge space rather than the reflecting layer. Also, the plasma display panel comprises a phosphor film holding portion holding the phosphor film. A thickness of the phosphor film, namely, a phosphor film thickness Wt is 40 μm or less, and a thickness of the phosphor layer, namely, a phosphor layer thickness Wp, a particle diameter of phosphor which is at least a part of components of the phosphor layer, namely, a phosphor particle diameter dp, a thickness of the reflecting layer, namely, a reflecting layer thickness Wr, and a particle diameter of a reflecting material which is at least a part of components of the reflecting layer, namely, a reflecting material particle diameter dr satisfy $2dp \leqq Wp \leqq 5dp$ and $2dr \leqq Wr \leqq Wt-Wp$.

The effects obtained by typical aspects of the present invention will be briefly described below.

According to the present invention, a high-luminance plasma display panel and a plasma display apparatus using the same can be provided.

Further, a high-performance plasma display panel which can achieve both high luminance and high contrast and a plasma display apparatus using the same can be provided.

BRIEF DESCRIPTIONS OF THE DRAWINGS

BEST MODE FOR CARRYING OUT THE INVENTION

Hereinafter, embodiments of the present invention will be described in detail with reference to the accompanying drawings. Note that components having the same function are denoted by the same reference symbols throughout the drawings for describing the embodiment, and the repetitive description thereof will be omitted. In addition, the description of the same or similar portions is not repeated in principle unless particularly required. Also, in the present application, the term "phosphor layer" indicates a layer having a function of converting ultraviolet light to visible rays to emit light, and the term "reflecting layer" indicates a layer having a function of reflecting visible rays emitted from a phosphor toward a discharge space side. In this application, the term "phosphor film" indicates a film configured to contain phosphor, and it is discriminated from the term "phosphor layer". Also, in the present application, "front substrate" and "rear substrate" will be explained such that a substrate serving as a display surface through which emitted rays from the phosphor pass is the front substrate and a substrate which does not serve as the display surface is the rear substrate when both the substrates are assembled as a panel.

(Concept of Achieving High Luminance)

Figure 15:
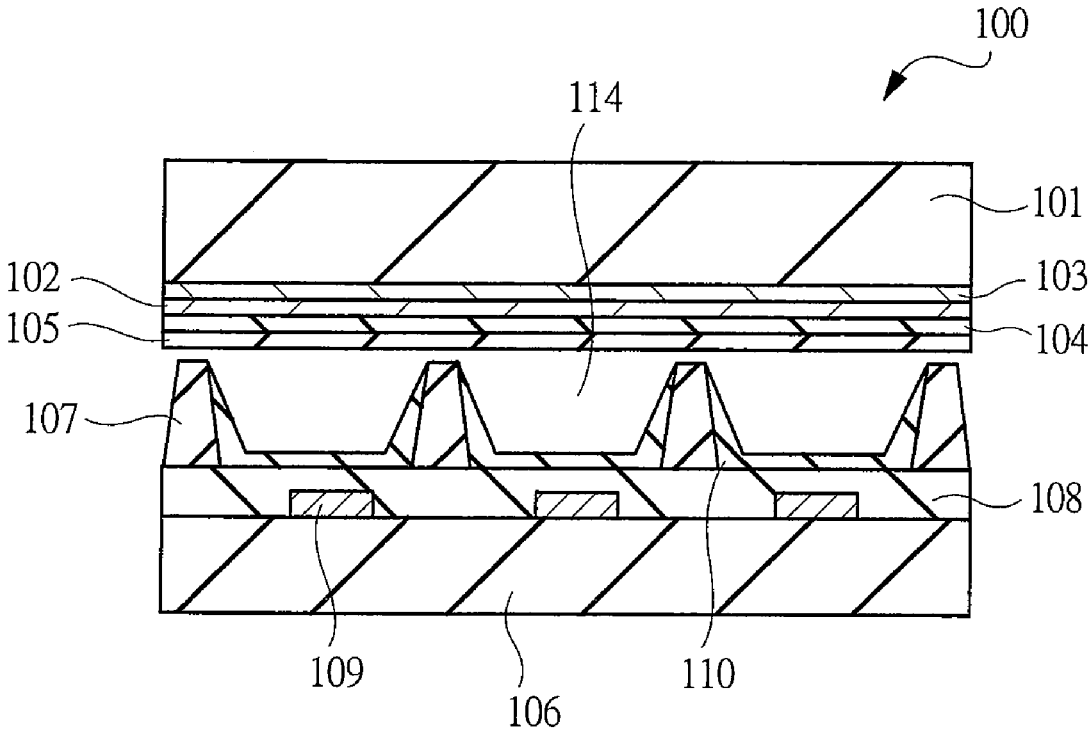
FIG. 15 is a cross-sectional view of main parts schematically showing a plasma display panel which has been studied by the present inventors.

FIG. 15 is a cross-sectional view of main parts schematically illustrating a plasma panel 100 which has been studied by the present inventors. Incidentally, FIG. 15 a front substrate 101 and a back substrate 106 are illustrated being separated for easily understanding the structure.

As shown in FIG. 15, a bus electrode 103, a transparent electrode 102, a dielectric 104, and a protective film 105 are disposed on the front substrate 101 in this order. On the other hand, address electrodes 109 are disposed on the back substrate 106 and a dielectric 108 is disposed so as to cover the address electrodes 109. Barrier ribs 107 are disposed on the dielectric 108 and a phosphor film 110 is disposed between barrier ribs 107 adjacent to each other. A discharge space 114 is formed between the front substrate 101 and the back substrate 106 by attaching the front substrate 101 and the back substrate 106 facing each other, so that the plasma panel 100 is configured.

Here, a volume of the discharge space 114 varies according to change of a thickness of the phosphor film 110, and the film thickness of the phosphor film 110 is set to a film thickness which maintains discharge in the discharge space 114. The phosphor film 110 in the plasma panel 100 is formed to have a thickness of about 25 μm, for example. Increase of the film thickness of the phosphor film 110 is considered for achieving high luminance, but occurrence of various adverse effects due to the increase of the film thickness is concerned.

For example, there are lowering of an ultraviolet light generation efficiency caused by narrowing of the discharge space 114, rising of driving voltage for driving the plasma panel 100, and so forth. Since the increase of the film thickness of the phosphor film 110 reduces an effect of high luminance while influence of such adverse effects is expanded, it cannot be greatly expected as a technique for achieving high luminance for a plasma display.

Figure 16:
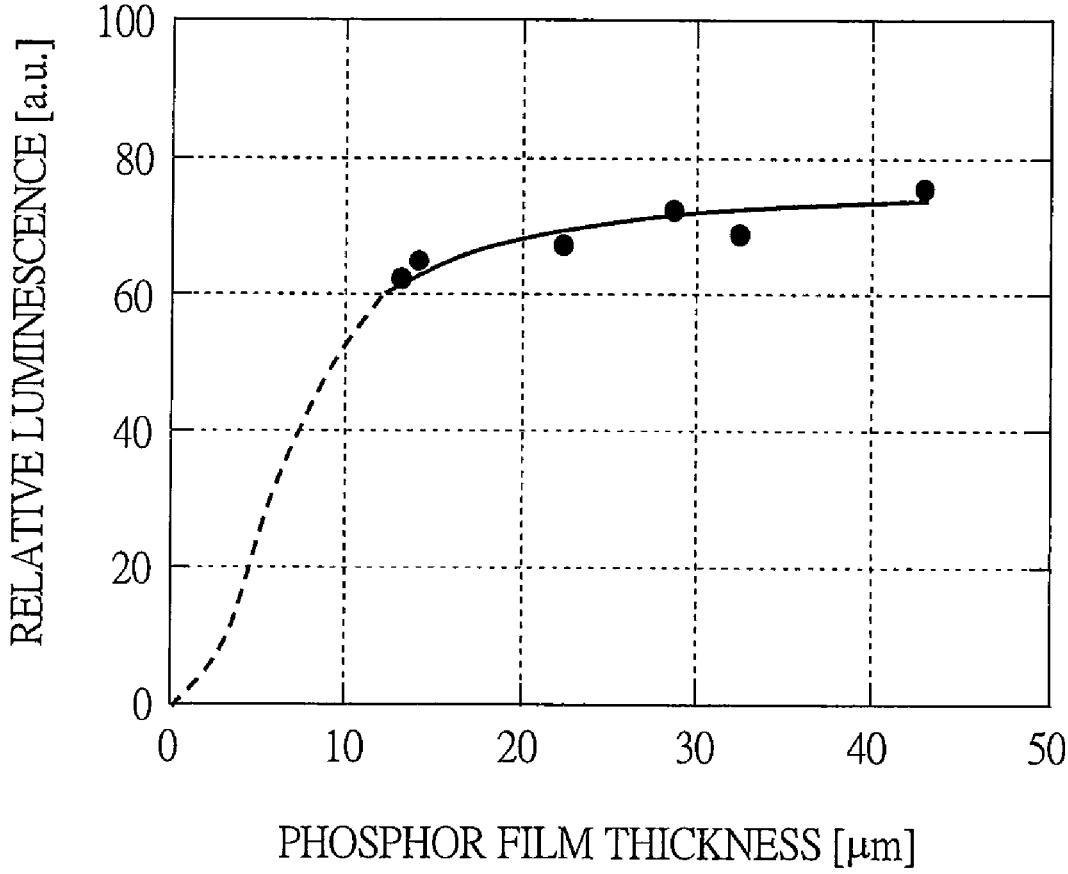
FIG. 16 is an explanatory diagram showing a relationship between a film thickness of a phosphor film and relative luminance.

A graph showing a relationship between a film thickness of the phosphor film 110 and relative luminance is illustrated in FIG. 16. As illustrated in FIG. 16, improvement of luminance can be expected by increase of the film thickness of the phosphor film 110. However, when the film thickness of the phosphor film 110 reaches a certain film thickness or more (20 μm or more, in FIG. 16), the relative luminance is almost saturated, and thus improvement of the luminance corresponding to increase of the film thickness cannot be expected.

Therefore, it is necessary to improve such a relationship between the luminance and the film thickness of the phosphor layer in order to achieve high luminance of the plasma display. The present inventors have focused on a function of the phosphor film in order to improve such a relationship fundamentally and have found the best configuration (film thickness conditions etc.) for exerting respective functions maximally.

The function of the phosphor film will be described. Briefly describing, the phosphor film can have an emission function of converting ultraviolet light to visible rays and emit the same and a reflection function of radiating visible rays toward a front face of the panel.

In a structure such as a plasma panel, ultraviolet light generated within the discharge space is incident on the phosphor film from one direction. Therefore, when the film thickness of the phosphor film is thick, ultraviolet light does not reach a lower region of the phosphor film, so that the lower region does not serve as the emission function but serves as the reflection function.

For example, in the relationship between a phosphor film thickness and luminance illustrated in FIG. 16, it is considered that a portion of the phosphor film which serves as the emission function is an upper region of the phosphor film which is positioned from a surface of the phosphor film down to a depth of about 15 μm. It is considered that the lower region positioned below the depth of 15 μm (for example, a region from the surface of the phosphor film to a depth of about 30 μm) mainly serves as the reflection function. That is, the lower region serving as the reflection function is not required to be made of a phosphor film provided with the emission function, but it is desirable that the lower region is made of a material optimal for emitting visible rays toward the front face of the panel.

Thus, with focusing on the two functions of the phosphor film (phosphor function and reflection function), high luminance can be achieved by configuring the phosphor film to have a two-layer structure (a first configuration) separating the respective functions to a phosphor layer and a reflecting layer. High luminance can also be achieved by causing barrier ribs and dielectrics which are phosphor film holding portions for holding the phosphor film to have the reflection function, and adopting a phosphor film having only the phosphor function, namely, a one-layer configuration of a phosphor layer (a second configuration).

(First Configuration)

The first configuration in the present invention will be described. A phosphor film described here has at least two layers of a phosphor layer and a reflecting layer. That is, high luminance can be achieved by configuring the phosphor film to have a two-layer configuration including a phosphor layer and a reflecting layer. However, it is considered that high luminance cannot be achieved by simply providing a phosphor layer and reflecting layer and it can be achieved only when respective film thicknesses of a phosphor layer and a reflecting layer and optical characteristics satisfy certain conditions.

Therefore, the present inventors have found conditions of respective film thicknesses of a phosphor layer and a reflecting layer and optical characteristics (especially, reflection coefficient of the reflecting layer) which can realize high luminance. The film thicknesses for realizing high luminance will be described below. Incidentally, Patent Document 1 (Japanese Patent Application Laid-Open Publication No. H11-204044) and Patent Document 2 (Japanese Patent Application Laid-Open Publication No. 2000-11885) describe configurations where a reflecting layer is provided under a phosphor layer. In these Patent Documents 1 and 2, however, a relationship between a phosphor layer thickness and a reflecting layer thickness, and further, diameters of particles forming the respective layers for realizing high luminance is not shown. When these conditions are not optimized, even if a similar configuration is adopted, lowering of luminance may occur. In the present invention, conditions of a film thickness which can realize high luminance are clarified with focusing attention on two functions of the phosphor film and examining the relationship between the film thickness and the reflecting characteristic and the particle diameter.

Figure 1:
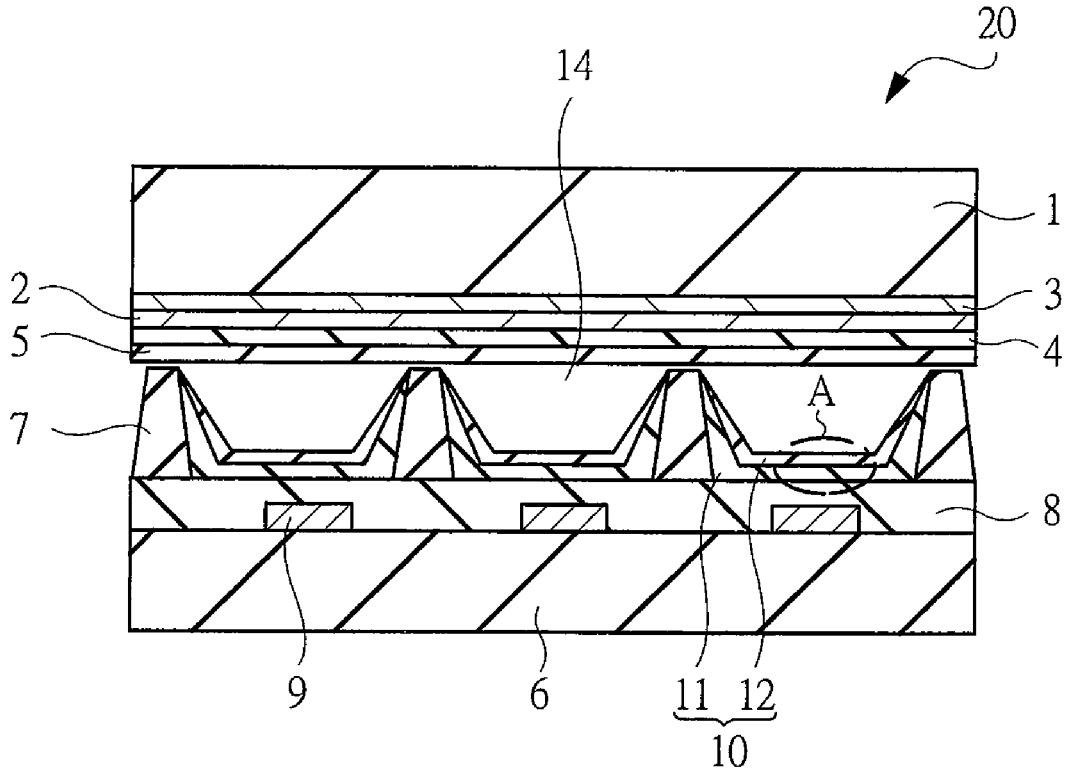
FIG. 1 is a cross-sectional view of main parts schematically illustrating a plasma display panel which is an embodiment of the present invention.
Figure 1:
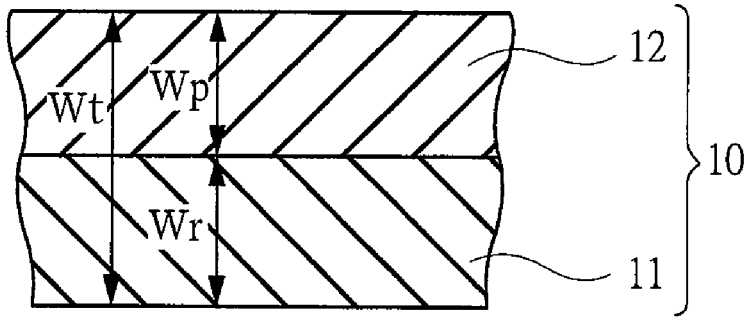

FIG. 1 is a cross-sectional view of main parts schematically showing a plasma panel 20 according to an embodiment of the present invention. Note that FIG. 1 shows a state where a front substrate 1 has been separated from a back substrate 6 for easily understanding a structure of the plasma panel 20.

As shown in FIG. 1, a bus electrode 3, a transparent electrode 2, a dielectric 4, and a protective film 5 are disposed on the front substrate 1 in this order. The bus electrode 3 is made of a low resistance material such as silver, copper, and aluminum, the transparent electrode 2 is made of a transparent conductive material such as ITO (indium tin oxide), the dielectric 4 is made of a transparent insulating material such as a glass material containing $SiO_2$ and/or $B_2O_3$ as its main component, and the protective film 5 is made of such material as magnesium oxide (MgO).

On the other hand, address electrodes 9 are disposed on the back substrate 6 on the side where the back substrate 6 is attached to the front substrate 1 facing each other, and a dielectric 8 is disposed so as to cover the address electrodes 9. A plurality of barrier ribs 7 are disposed on the dielectric 8 at equal intervals. A phosphor film 10 is disposed on the dielectric 8 and side surfaces of the barrier ribs 7 between adjacent barrier ribs 7. The phosphor film 10 comprises a phosphor layer 12 and a reflecting layer 11, as shown in an enlarged view of a portion "A" in FIG. 1, where the phosphor layer 12 is disposed closer to the a discharge space side than the reflecting layer 11. The barrier rib 7 is made of a transparent insulating material such as a glass material containing $SiO_2$ and/or $B_2O_3$ as its main component.

A discharge space 14 is formed between the front substrate 1 (the protective film 5) and the back substrate 6 (the phosphor film 10) by bonding the front substrate 1 and the back substrate 6 together in an opposing manner, so that discharge cells are formed. A volume of the discharge space 14 affects stable discharge. Therefore, since the volume of the discharge space 14 varies according to change of the film thickness of the phosphor film 10, the film thickness of the phosphor film 10 is set to be a film thickness for performing discharge in the discharge space 14.

FIG. 1 illustrates three discharge cells corresponding to three primary colors of RGB (red, green, and blue). The discharge cells are arranged in matrix so that the plasma panel 20 is formed. Incidentally, though not illustrated, attachment of the front substrate 1 and the back substrate 6 is made by sealing by a low melting point glass material applied to peripheral portions of the respective substrates, and after evacuating is performed through an exhaust hole generally opened on the back substrate 6, gas such as mixed gas of Ne and Xe is charged and sealed.

In this manner, the plasma panel 20 includes at least a plurality of discharge cells as part of components, where the discharge cell includes electrodes for applying voltage to the discharge cell, discharge gas for forming discharge, the discharge space 14 where discharge is formed, and the phosphor film 10 emitting visible rays utilizing excitation caused by ultraviolet light generated by discharging as at least part of constituent elements.

When a particle diameter of the phosphor to be excited by discharge is small, emission efficiency of phosphor (ultraviolet light-visible ray conversion efficiency) lowers due to increase of a phosphor surface area. This is because surface defects of phosphor particles increase. On the other hand, when the particle diameter of the phosphor is large, a dense film cannot be formed, which results in efficiency lowering. Accordingly, the particle diameter of the phosphor is preferably in a range of 2 μm to 7 μm, more preferably, in a range of 3 μm to 5 μm.

Note that, as the phosphor material for the plasma display panel, blue color phosphor $BaMgAl_{10}O_{17}:Eu^{2+}$, green color phosphor $Zn_2SiO_4:Mn^{2+}$, and red color phosphor (Y,Gd) $BO_3:Eu^{3+}$ are generally used. Incidentally, as the general description of phosphor materials, the portion before ":" indicates host material composition and the portion after indicates luminescence center and means that substitution of atoms of a part of the host material has been performed at the luminescence center.

Here, the thickness of the phosphor film 10, namely, the phosphor film thickness is defined as Wt, the thickness of the phosphor layer 12, namely, the phosphor layer thickness is defined as Wp, and the thickness of the reflecting layer 11, namely, the reflecting layer thickness is defined as Wr. That is, the film thickness Wt of the phosphor film 10 is equal to the sum of the film thickness Wp of the phosphor layer 12 and the film thickness Wr of the reflecting layer 11.

For example, in a plasma panel of 42-inch XGA, a size of its discharge cell (a pitch of barrier ribs 7 in FIG. 1) is about 300 μm. In the case of the structure of the plasma panel 20, Debye length which is a measure for maintaining discharge stably is in a range of about $10^{-6}$ m to $10^{-4}$ m, and a width of the discharge space 14 requires at least 100 μm.

Accordingly, when the size of the discharge cell is about 300 μm and an average width of the barrier ribs 7 is about 120 μm, the upper limit of the film thickness Wt of the phosphor film 10 is 40 μm ((discharge cell size—width of discharge space 14—width of barrier rib 7)/2) in order to maintain discharge stably.

In addition, since the cell size is reduced for achieving high fineness, further constraint on the upper limit of the film thickness Wt of the phosphor film 10 occurs in order to secure the discharge space 14. For example, the cell size becomes about 160 μm in the full HD that will be the main trend in the future digital broadcasting. At this time, when calculation is performed at a ratio of 42-inch XGA considering the width 100 μm of the discharge space 14 at least required for discharge, the upper limit of the film thickness Wt of the phosphor film 10 becomes 15 μm.

Next, the condition of the film thickness Wp of the phosphor layer 12 configuring the phosphor film 10 will be described. Here, a particle diameter of the phosphor configuring at least a part of components of the phosphor layer 12, namely, a phosphor particle diameter is defined as dp. The particles of the phosphor have a certain distribution. That is, the particle diameter in the present application means a mean particle diameter, which is a particle diameter in the case where mass occupies 50% or more of the weight of the whole powder in the particle distribution. The particle diameter dp can be measured by Counter Coal method, for example. Incidentally, as described above, when the particle diameter of phosphor excited by discharge is small, the light emission efficiency of the phosphor lowers according to increase of the phosphor surface area, but when the particle diameter of the phosphor is large, a dense film cannot be formed, which results in efficiency lowering. Therefore, the particle diameter dp of the phosphor is preferably in a range of 2 μm to 7 μm, more preferably in a range of 3 μm to 5 μm.

In order for the phosphor layer 12 comprising particles of phosphor to serve as emission function, at least phosphor particles must configure two or more layers on an average. That is, the lower limit of the film thickness Wp of the phosphor layer 12 is set to satisfy $2dp \leqq Wp$. When the film thickness is less than 2dp, the phosphor layer 12 is in a coarse state, and ultraviolet light from the discharge space 14 go through the phosphor easily without being converted to visible rays, so that the phosphor layer 12 does not serve as the luminescence function.

On the other hand, the upper limit of the film thickness Wp of the phosphor layer 12 is determined according to two factors. One is the maximum film thickness constrained from a relationship between an adverse effect such as driving voltage rising and luminance described previously. The other is the maximum film thickness such that visible rays emitted at the phosphor layer 12 reaches the reflecting layer 11 sufficiently and the reflecting layer 11 sufficiently serves as reflecting function. When the film thickness Wp of the phosphor layer 12 is extremely thick, visible rays emitted at the phosphor layer 12 do not reach the reflecting layer 11, so that the effect of the reflecting layer 11 disappears completely.

Figure 2:
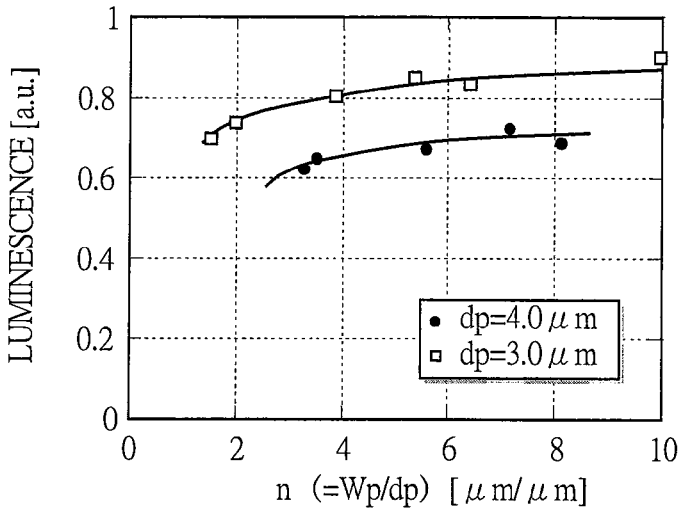
FIG. 2 is a graph illustrating a relationship between an average number of layers of particle diameters configuring a phosphor layer and luminance.
Figure 3:
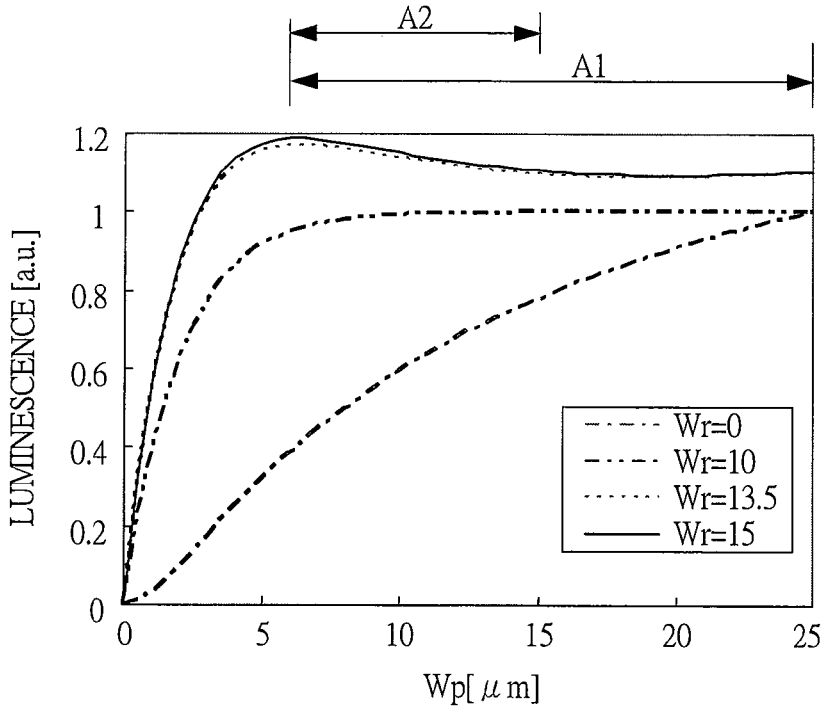
FIG. 3 is a graph illustrating a relationship between a film thickness of a phosphor layer formed on a reflecting layer and luminance.

FIG. 2 is a graph showing a relationship between an average number of layers "n" of the particle diameter dp configuring the phosphor layer 12 and luminance, where the particle diameter dp is used as a parameter (dp=3.0, 4.0 μm). FIG. 3 is a graph showing a relationship between the film thickness Wp of the phosphor layer 12 (particle diameter dp=4.0 μm) formed on the reflecting layer 11 and luminance, where the film thickness Wr of the reflecting layer 11 is used as a parameter (Wr=0, 10, 13.5, 15 μm). Incidentally, the average number of layers n is a value obtained by dividing the film thickness Wp of the phosphor layer 12 by the particle diameter dp of the phosphor.

As shown in FIG. 2, in respective cases of dp=3.0 and 4.0 μm, even if the average number of layers n of the phosphor layer 12 increases, luminance is almost saturated when the average number of layers n is 5 or more, so that improvement of luminance cannot be expected. An adverse effects such as rising of driving voltage or decrease of the discharge space 14 as previously described occur according to increase of the average number of layers n (namely, increase of the thickness of the phosphor layer 12). Further, as shown in FIG. 3, when the film thickness Wp of the phosphor layer 12 is 20 μm or more (in FIG. 3, the film thickness Wp=20 μm corresponding to the average number of layers n=5 because dp=4.0 μm), the luminance does not change regardless of presence/absence of the reflecting layer 11. That is, when the film thickness Wp of the phosphor layer 12 is thick like 20 μm or more, the reflecting layer 11 does not serve as the reflecting function. From this, it is optimal that the upper limit of the film thickness Wp of the phosphor layer 12 having only the emission function is set to Wp≦5dp.

Accordingly, the condition of the film thickness Wp of the phosphor layer 12 configuring the phosphor film 10 is represented by the following expression.

(Mathematical Expression 1)

$$2dp \leqq Wp \leqq 5dp \quad \text{(Expression 1)}$$

Next, the condition of the film thickness Wr of the reflecting layer 11 configuring the phosphor film 10 will be described. Here, the particle diameter of the reflecting material (particles) configuring at least a part of the components of the reflecting layer 11, namely, a reflecting material particle diameter is defined as dr. The particle diameter dr means a mean particle diameter. It is desirable that the particle diameter dr of the reflecting material forming the reflecting layer 11 is smaller than the particle diameter dp of the phosphor. This is because a reflection coefficient higher than that of the phosphor can be obtained easily as a packing density of particles becomes higher according to decrease of the particle diameter. Specifically, it is desirable that the particle diameter dr of the reflecting material is in a range of 0.5 μm to 4 μm. When such a particle diameter is adopted, reflection coefficient higher than that of the phosphor layer having a film thickness substantially equal to that of the reflecting material can be obtained.

In order for the reflecting layer 11 to serve as the reflecting function, at least reflecting material particles must form at least two layers on an average. That is, the lower limit of the film thickness Wr of the reflecting layer 11 is optimally set to satisfy 2dr≦Wr. When the film thickness Wr is less than 2dr, the reflecting layer 11 is in a coarse state, so that visible rays from the phosphor layer 12 go through the reflecting layer 11 and the reflecting layer 11 does not serve as the reflecting function.

On the other hand, regarding the upper limit of the film thickness of the reflecting layer 11, only its reflection coefficient can be considered, where the reflecting layer 11 is desirably formed to be thicker because the reflection coefficient fundamentally becomes higher as it becomes thicker. However, in view of limitation regarding the film thickness of the phosphor film 10 composed of the reflecting layer 11 and the phosphor layer 12, it is necessary to satisfy Wr≦(Wt−Wp).

Accordingly, the condition of the film thickness Wr of the reflecting layer 11 configuring the phosphor film 10 is represented by the following expression.

(Mathematical Expression 2)

$$2dr \leqq Wr \leqq (Wt - Wp) \quad \text{(Expression 2)}$$

As described above, the first configuration of the present invention lies in that the phosphor film 10 is composed of the phosphor layer 12 and the reflecting layer 11. In the plasma panel 20 having discharge cells with a predetermined size, it is required that the film thickness Wp of the phosphor layer 12 and the film thickness Wr of the reflecting layer 11 satisfy both the (Expression 1) and the (Expression 2) simultaneously in order to obtain high luminance, and the film thickness Wt of the phosphor film 10 is made thin in order to maintain discharge stably. For example, when the size of the discharge cells is set to about 300 μm and 160 μm, the film thickness Wt of the phosphor film is 40 μm or less and 15 μm or less, respectively.

In order to obtain high luminance of the plasma panel 20 in this manner, the relationship between the film thickness Wp of the phosphor layer 12 and the film thickness Wr of the reflecting layer 11 becomes important. When the relationship cannot be optimized, even if the phosphor film 10 is composed of the phosphor layer 12 and the reflecting layer 11, an effect of the reflecting layer 11 under the phosphor layer 12 is reduced, for example, when the film thickness Wp of the phosphor layer 12 is very thick, so that it cannot be expected to achieve high luminance.

In the following, dependency of the plasma panel 20 on luminance will be examined using specific numerical values, namely, using the film thickness Wp of the phosphor layer 12 and the film thickness Wr of the reflecting layer 11 as parameters.

First, the film thickness Wp of the phosphor layer 12 will be described. The luminance of the phosphor layer 12 in the case of disposing the reflecting layer 11 (Wr=10, 13.5, 15) and the luminance of the phosphor layer 12 in the case of not disposing the reflecting layer 11 (Wr=0) are compared with each other with reference to FIG. 3. When the film thickness Wp of the phosphor layer 12 is 20 μm or more, the luminance does not change substantially regardless of presence/absence of the reflecting layer 11, but when the film thickness Wp of the phosphor layer 12 is thinner than 20 μm, the luminance changes according to presence/absence of the reflecting layer 11.

When the reflecting layer 11 is provided, high luminance is obtained in a state that the film thickness Wp of the phosphor layer 12 is in a range of 6 μm to 25 μm (range A1). Further, the film thickness Wp of the phosphor layer 12 is set in a range of 6 μm to 15 μm (range A2) in order to obtain significant effect which can be detected by human vision.

Figure 4:
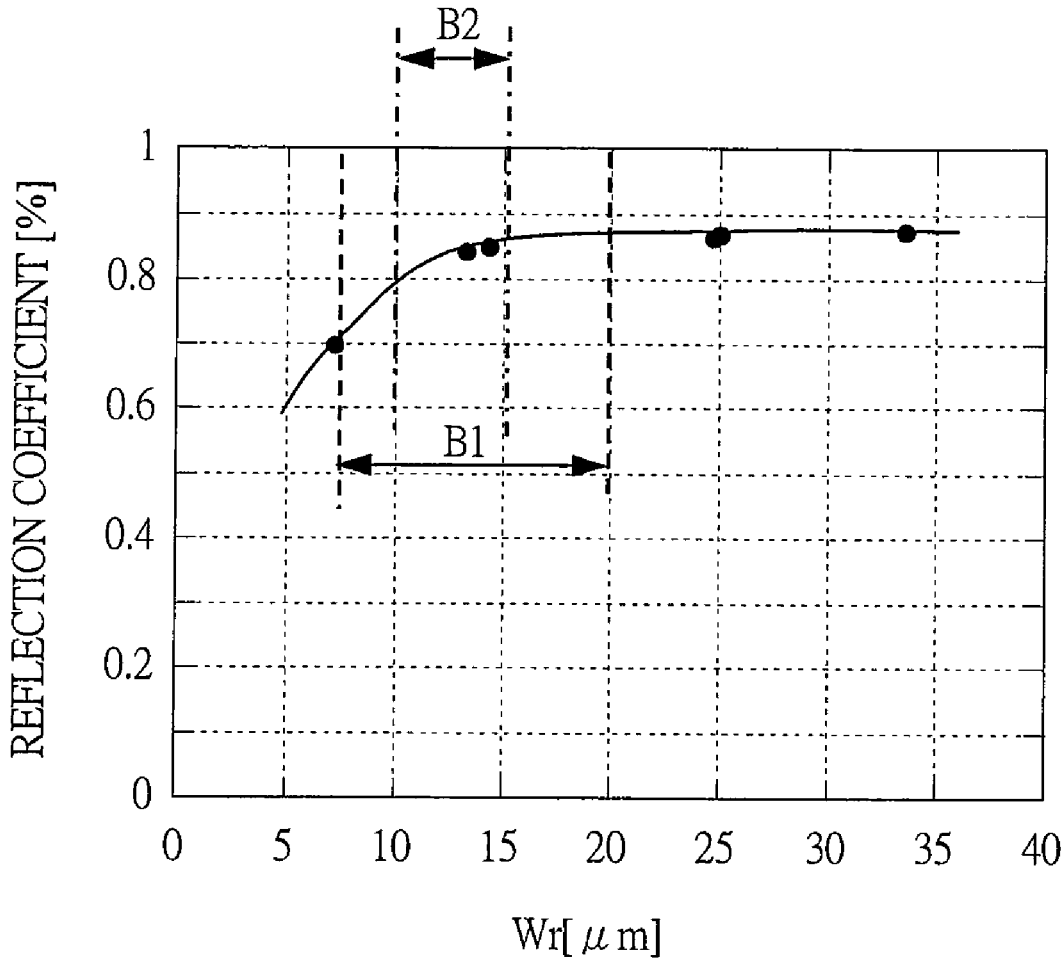
FIG. 4 is a graph illustrating a relationship between a film thickness of a reflecting layer and a reflection coefficient thereof.

Next, the film thickness Wr of the reflecting layer 11 will be described. FIG. 4 is a graph illustrating a relationship between the film thickness Wr of the reflecting layer 11 and the reflection coefficient. The horizontal axis indicates the film thickness Wr of the reflecting layer, while the vertical axis indicates reflection coefficient. Incidentally, the reflecting layer 11 used here is made of titanium oxide ($TiO_2$).

As the reflection coefficient, total reflection is adopted, and the role of the reflecting layer 11 is for reflecting visible rays from the phosphor layer 12 arranged so as to contact with the reflecting layer 11 towards the front surface, where it is desirable that the total reflection including specular reflection and diffusion reflection is used as an index. Since visible rays are reflected towards the front surface efficiently, an average value of the reflection coefficient of a waveform falling in a wavelength range of the visible range (380 nm to 780 nm) is considered here. Thus, the reflection coefficient of the reflecting layer 11 means the total reflection including specular reflection coefficient in the present application.

As shown in FIG. 4, the reflection coefficient becomes high according to increase of the film thickness Wr of the reflecting layer 11, the reflection coefficient becomes substantially constant when the film thickness Wr reaches a certain fixed value or higher, so that improvement of the reflection coefficient can hardly be obtained corresponding to increase of the film thickness Wr of the reflecting layer 11. When the film thickness Wr of the reflecting layer 11 is 20 or more, the reflection coefficient becomes a fixed value at about just below 90%.

The role of the reflecting layer 11 is to reflect visible rays from the phosphor layer 12 towards the front surface efficiently. Accordingly, it is the condition to be satisfied by the reflecting layer 11 that the reflecting layer 11 has a reflection coefficient higher than that of the phosphor layer 12 in order to fulfill the role as the reflecting layer 11 at least. Since the reflection coefficient of a phosphor used in the phosphor layer 12 utilized in a general plasma display or the like is 68 to 70%, it is found from FIG. 4 that at least the reflecting layer 11 is required to have a reflection coefficient of 70% or more. That is, it is desirable that the film thickness of the reflecting layer 11 is 7 μm or more.

It is desirable that the reflection coefficient of the reflecting layer 11 is high to a maximum extent. Especially, in the case of a cell size for high resolution (for example, full high definition or the like), it is necessary to reduce the film thickness Wt of the phosphor film 10 in order to secure the discharge space 14. In this case, the reflection coefficient of the reflecting layer 11 is required to be 85% or more.

On the other hand, it is desirable that the film thickness Wr is smaller in order to secure the discharge space 14 and suppress increase of driving voltage, and accordingly, it is desirable that the film thickness Wr of the reflecting layer 11 is 20 μm or less.

Therefore, the film thickness Wr of the reflecting layer 11 is set to fall in a range of 7 μm to 20 μm (range B1) in order to obtain high luminance of the plasma panel 20 in the present invention. Further, in the case of achieving both reduced film thickness and high reflection, the film thickness Wr of the reflecting layer 11 is set to fall in a range of 10 μm to 15 μm (range B2) in order to secure the discharge space and obtain high luminance of plasma panel 20 when the reflection coefficient of the reflecting layer 11 is 80% or more.

Figure 5:
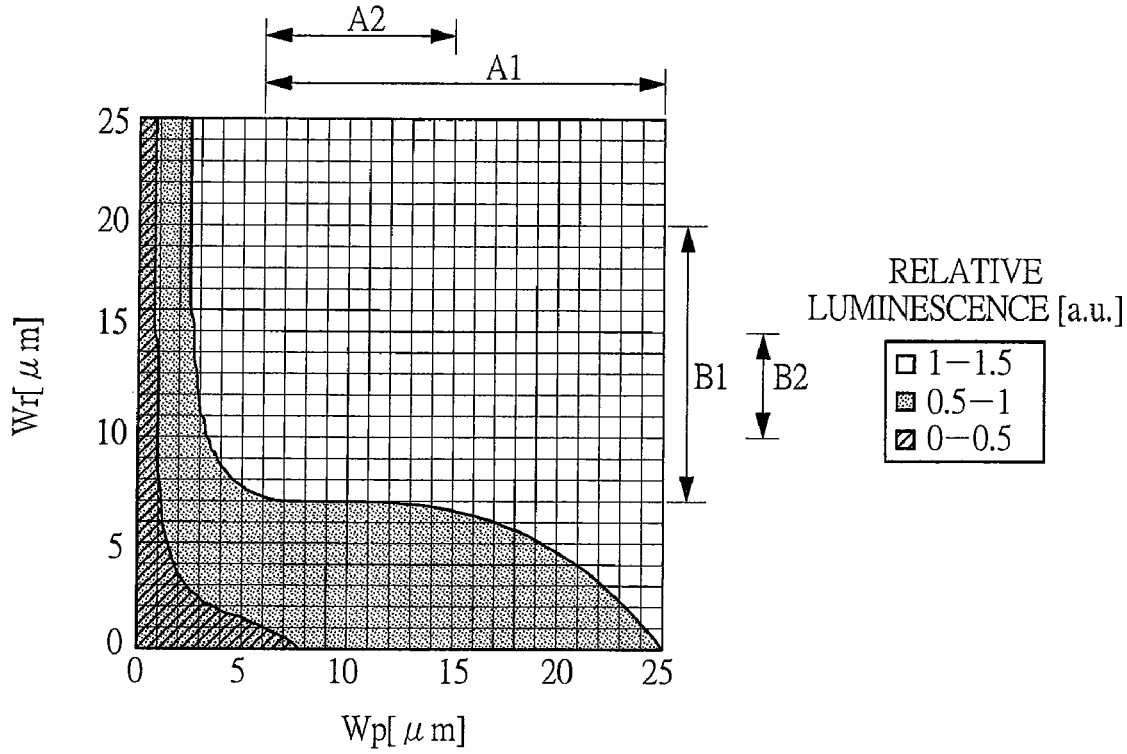
FIG. 5 is a contour graph illustrating a luminance to a film thickness of a phosphor layer and a film thickness of a reflecting layer.

Next, a relationship among the phosphor layer 12 and the reflecting layer 11, and luminance will be described. FIG. 5 illustrates luminance with respect to the film thickness Wp of the phosphor layer 12 and the film thickness Wr of the reflecting layer 11 using a contour graph. In FIG. 5, the horizontal axis (X axis) indicates the film thickness Wp of the phosphor layer 12, while the vertical axis (Y axis) indicates the film thickness Wr of the reflecting layer 11. The direction (Z axis) perpendicular to the sheet indicates relative luminance. A reference of the relative luminance is a relative value obtained when luminance of a plasma panel 20 comprising the phosphor layer 12 having the film thickness Wp=25 μm and the reflecting layer 11 having the film thickness Wr=0 μm is 1. In FIG. 5, the relationship among the film thickness Wp of the phosphor layer 12 and the film thickness Wr of the reflecting layer 11, and the luminance is sectioned by ranges of relative luminance 0 to 0.5, 0.5 to 1, and 1 to 1.5 by a line of the relative luminance 1 and a line of the relative luminance 0.5. Incidentally, the plasma panel 20 having the film thickness Wp=25 μm and the film thickness Wr=0 μm has the same structure as that of the plasma panel 100 which has been studied by the present inventors described with reference to FIG. 15.

As shown in FIG. 5, the relative luminance exceeds 1 in the range of the film thickness Wp of the phosphor layer 12 from 6 μm to 25 μm described with reference to FIG. 3 (range A1) and in the range of the film thickness Wr of the reflecting layer 11 from 7 μm to 20 μm described with reference to FIG. 4 (range B1). The relative luminance exceeds 1 and the relative luminance exceeds 1.05 in the range of the film thickness Wp of the phosphor layer 12 from 6 μm to 15 μm described with reference to FIG. 3 (range A2) and in the range of the film thickness Wr of the reflecting layer 11 from 10 μm to 15 μm described with reference to FIG. 4 (range B2).

Here, the relationship among the film thickness Wt of the phosphor film 10, the film thickness Wp of the phosphor layer 12, and the film thickness Wr of the reflecting layer 11 will be summarized. When a current discharge cell size is set to about 300 μm, the film thickness Wt of the phosphor film 10 is set to 40 μm in order to maintain discharge stably. That is, the upper limit of the film thickness Wt of the phosphor film 10 becomes 40 μm due to further reduction of the discharge cell size according to high definition. Therefore, since the film thickness Wt of the phosphor film 10 is the sum of the film thickness Wr of the reflecting layer 11 and the film thickness Wp of the phosphor layer 12, the upper limit of the film thickness Wr and the film thickness Wp becomes 40 μm.

When the size of the discharge cell is set to about 300 μm or less in this manner, the film thickness Wt of the phosphor film 10 is 40 μm or less. The film thickness Wp of the phosphor layer 12 is in a range of 6 μm to 25 μmm, more preferably, in a range of 6 μm to 15 μm. The film thickness Wr of the reflecting layer 11 is in a range of 7 μm to 20 μm, more preferably, in a range of 10 μm to 15 μm. A graph illustrated in FIG. 6 is obtained by adding these relationships to the graph illustrated in FIG. 5.

Figure 6:
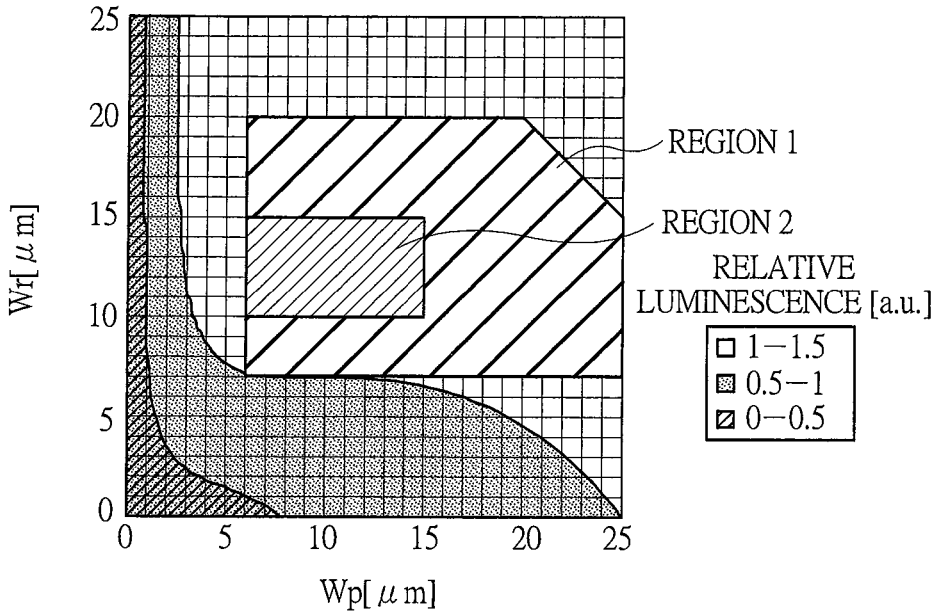
FIG. 6 is a contour graph illustrating a luminance to a film thickness of a phosphor layer and a film thickness of a reflecting layer and showing a film thickness range which can achieve an effect of the present invention when a film thickness of a phosphor film is 40 μm or less.

The region 1 illustrated in FIG. 6 is defined by adding a limitation of the film thickness of the phosphor film 10 Wt=40 μm to a region where the film thickness Wp of the phosphor layer 12 is in a range of 6 μm to 25 μm and the film thickness Wr of the reflecting layer 11 is in a range of 7 μm to 20 μm. The region 2 shown in FIG. 6 is defined by further adding a limitation such that the film thickness Wp of the phosphor layer 12 is in a range of 6 μm to 15 μm and the film thickness Wr of the reflecting layer 11 is in a range of 10 μm to 15 μm to the region 1.

When the film thickness Wp of the phosphor layer 12 and the film thickness Wr of the reflecting layer 11 fall within the region 1 in this manner, luminance higher than that of plasma panel 100 which has been studied by the present inventors can be obtained. Further, when the film thickness Wp of the phosphor layer 12 and the film thickness Wr of the reflecting layer 11 fall within the region 2, high luminance where the relative luminance exceeds 1.05 can be obtained.

Figure 7:
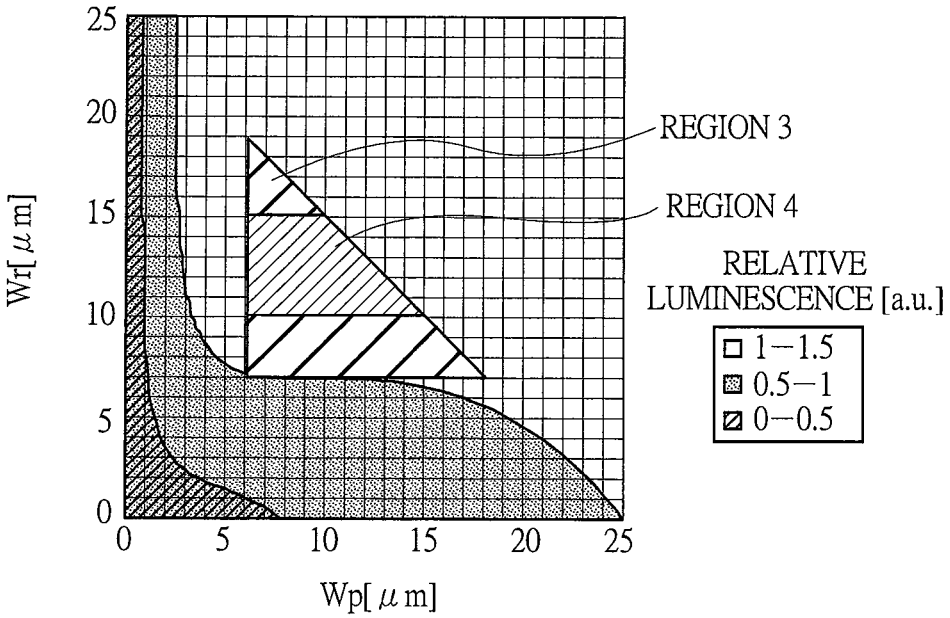
FIG. 7 is a contour graph illustrating a luminance to a film thickness of a phosphor layer and a film thickness of a reflecting layer and illustrating a film thickness range which can achieve an effect of the present invention when a film thickness of a phosphor film is 25 μm or less.

In addition, when the film thickness Wt of the phosphor film 10 is set to 25 μm, the graph illustrated in FIG. 5 changes to the graph illustrated in FIG. 7. The region 3 illustrated in FIG. 7 is defined by adding a limitation of the film thickness of the phosphor film 10 Wt=25 μm to the region where the film thickness Wp of the phosphor layer 12 is in a range of 6 μm to 25 μm and the film thickness Wr of the reflecting layer 11 is in a range of 7 μm to 20 μm. Further, the region 4 illustrated in FIG. 7 is defined by further adding a limitation where the film thickness Wp of the phosphor layer 12 is in a range of 6 μm to 15 μm and the film thickness Wr of the reflecting layer 11 is in a range of 10 μm to 15 μm to the region 3.

In this manner, even if the film thickness Wt of the phosphor film 10 becomes thin due to further reduction of the discharge cell size according to high definition, luminance of the plasma panel 20 can be increased to high luminance by selecting the film thickness Wp of the phosphor layer 12 and the film thickness Wr of the reflecting layer 11 falling within the region 3 illustrated in FIG. 7.

As the materials satisfying both the film thickness condition of the reflecting layer 11 and the reflection coefficient, there are zinc oxide, silicon oxide, magnesium oxide, barium sulfate, alumina, and the like in addition to titanium oxide, where the characteristic required as the reflecting layer 11 of the present invention can be satisfied as long as at least one of these materials is mixed in the material forming the reflecting layer.

Note that, while the structure where the phosphor layer and the reflecting layer contact with each other has been described in the above description, such a structure that another member or a space is disposed between the phosphor layer and the reflecting layer can be adopted as another configuration. The latter structure is the same as the former one regarding such an idea to obtain a film for achieving high luminance, and the latter structure is also applicable.

(Second Configuration)

The second configuration of the present invention will be described. The basic concept to achievement of high luminance is the same as the first configuration. However, in the second configuration, such a configuration that barrier ribs or dielectrics which are phosphor film holding portions (base) holding the phosphor film are caused to serve as a reflecting layer is adopted.

For the high definition of the future plasma display, since the cell size becomes small (the discharge space becomes small), forming a reflecting layer in a cell results in lowering of efficiency. Therefore, the function of the reflecting layer described in the first configuration is assumed by the barrier ribs or the dielectric layer of lower layer, thereby suppressing reduction of the discharge space.

Figure 8:
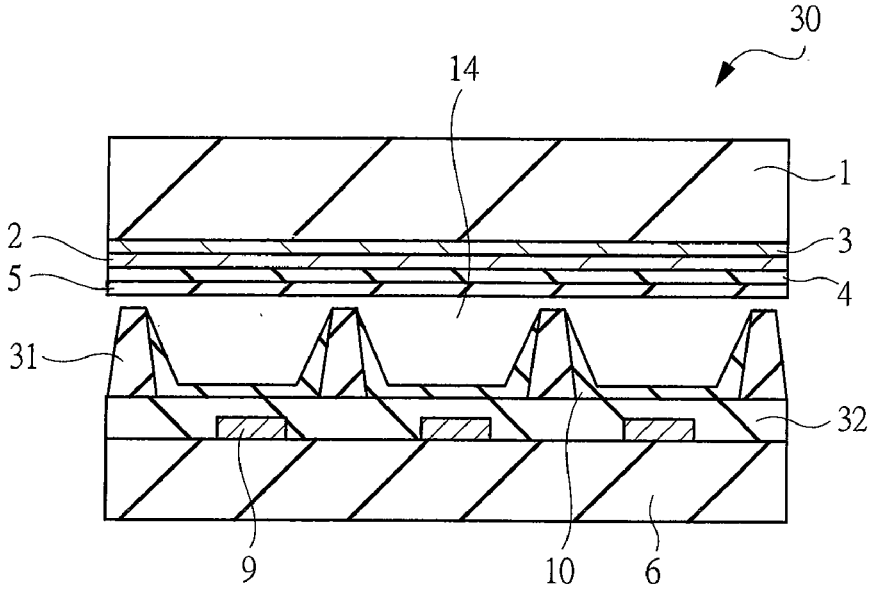
FIG. 8 is a cross-sectional view of main parts schematically illustrating a plasma display panel according to an embodiment of the present invention.

FIG. 8 is a cross-sectional view of main parts schematically illustrating a plasma panel 30 according to an embodiment of the present invention. Incidentally, FIG. 8 illustrates a state where the front substrate 1 has been separated from the back substrate 6 for understanding the structure easily.

In this manner, the plasma panel 30 has at least a plurality of discharge cells as part of components similarly to the above-described plasma panel 20, where the discharge cell includes electrodes for applying voltage to the discharge cell, discharge gas for forming discharge, the discharge space 14 where discharge is formed, the phosphor film 10 emitting visible rays according to excitation caused by ultraviolet light generated by discharge as at least part of components. The plasma panel 30 includes a phosphor film holding portion (barrier ribs 31 and a dielectric 32 of the back substrate 6 in FIG. 8) holding the phosphor film 10.

Here, the thickness of the phosphor film 10, namely, a phosphor film thickness is defined as Wt, a particle diameter of phosphor which is at least a portion of constituent elements of the phosphor film 10, namely, a phosphor particle diameter is defined as dp, and a reflection coefficient of at least a part of a surface holding the phosphor film of the phosphor film holding portion is defined as βs. Incidentally, as described above, when the particle diameter of phosphor to be excited by discharge is small, a luminescence efficiency of the phosphor lowers due to increase of a phosphor surface area, but when the particle diameter of the phosphor is large, a dense film cannot be formed, which results in efficiency lowering; therefore, the particle diameter dp of the phosphor is in a range of 2 μm to 7 μm, and more preferably, in a range of 3 μm to 5 μm.

In order to obtain the plasma panel 30 with high luminance, such a condition that the film thickness Wt of the phosphor 10 is at least two times the phosphor particle diameter dp must be satisfied like the first configuration. This is because it is a minimal film thickness necessary for functioning as a film.

On the other hand, it is desirable that the upper limit of the film thickness Wt is 5dp or less. When the film thickness exceeds that, improvement of luminance cannot be expected as compared to increase of the film thickness. Therefore, increase of thickness more than that causes decrease of the discharge space and increase of influence of such an adverse effect like increase of driving voltage. When the film thickness exceeding that is adopted, the effect of the high reflection base serving as a base for the phosphor film will be completely lost.

Accordingly, the condition of the film thickness Wt of the phosphor film 10 is represented by the following expression.

(Mathematical Expression 3)

$$2dp \leqq Wt \leqq 5dp \quad \text{(Expression 3)}$$

In order for the barrier rib 31—which is the phosphor film holding portion and the dielectric 32 positioned under the barrier rib to serve as the reflecting function, the reflection coefficient βs of the phosphor film holding portion is at least higher than the reflection coefficient of the phosphor configuring the phosphor film 10. In this regard, since the reflection coefficient of the phosphor used in the phosphor film 10 is in a range of 68 to 70%, at least the phosphor film holding portion is required to have the reflection coefficient of 70% or higher. In addition, it is desirable that the reflection coefficient βs is high to a maximum extent. Especially, in the case of a cell size with high resolution (for example, full high definition or the like), the reflection coefficient βs is required to be 85% or more.

Accordingly, for obtaining the plasma panel 30 having high luminance, the condition of the reflection coefficient βs of the barrier rib 31 which is the phosphor film holding portion and the dielectric 32 positioned at a lower layer is represented by the following expression.

(Mathematical Expression 4)

$0.70 \leqq \beta s$ (Expression 4)

Incidentally, the reflection coefficient used here is the total reflection and it is a reflection coefficient in a visible region. In order to satisfy these conditions of reflection, it is desirable that one of components configuring the material for the phosphor film holding portion (base) is titanium oxide, zinc oxide, silicon oxide, magnesium oxide, barium sulfate, alumina, or mixture of these materials.

(Concept of Achieving High Contrast)

The configuration for realizing high luminance has been described above, but another object of the present invention is to achieve high contrast.

Particularly, in the second configuration described above, the reflection coefficient of the barrier rib which is the phosphor film holding portion (base) is high. In this case, light (outside light) incident from the outside of the plasma panel is reflected by the barrier ribs so that luminance at a black color display time (namely, black luminance) becomes high. Such a fact results in lowering of contrast. Especially, the influence becomes significant in a bright room. Therefore, for obtaining a plasma panel having high contrast, two functions will be described below.

First, a first function is to make a reflection coefficient βt 5% or less, βt of the surface other than faces holding the phosphor film of the barrier rib which is the phosphor film holding portion, namely, a top portion of the barrier rib which does not contact with the phosphor film. Thereby, reflection of unnecessary outside light is suppressed so that black luminance can be lowered.

Figure 9:
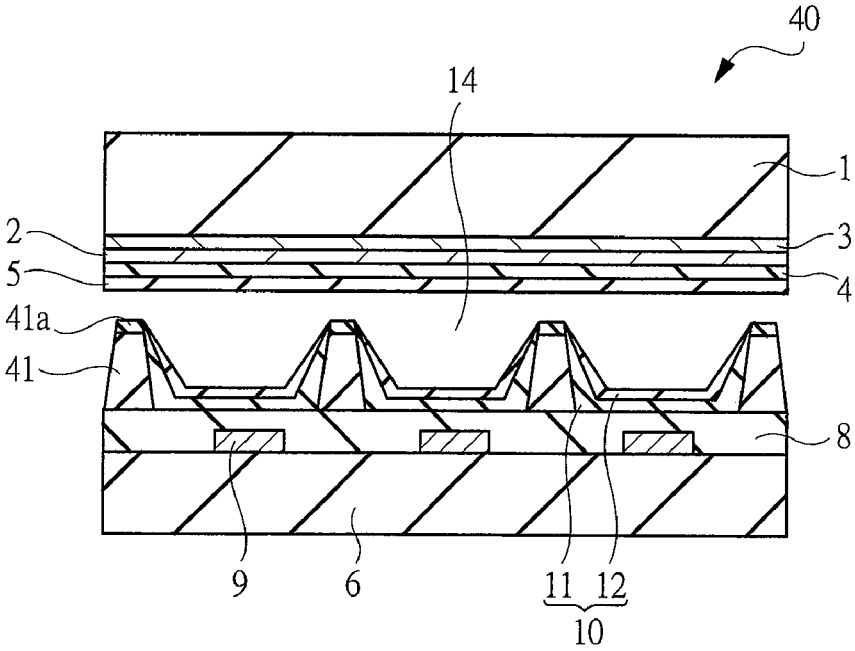
FIG. 9 is a cross-sectional view of main parts schematically illustrating a plasma display panel according to an embodiment of the present invention.

FIG. 9 is a cross-sectional view of main parts schematically illustrating a plasma panel 40 according to an embodiment of the present invention. Incidentally, FIG. 9 shows a state that the front substrate 1 is separated from the back substrate 6 for understanding the structure of the plasma panel 40 easily.

In the plasma panel 40 illustrated in FIG. 9, a reflection coefficient βs of a top portion 41*a* of a barrier rib 41 is set to 5% or less. The top portion 41*a* of the barrier rib 41 is a factor for reflecting outside light (room light) to lower a bright-room contract. Therefore, it is desirable that the reflection coefficient of the top portion 41*a* of the barrier rib 41 is as low as possible. Especially, when the reflection coefficient is 5% or less, it is difficult for human vision to recognize reflected light, which is much effective for the bright-room contrast improvement effect.

By forming the top portion 41*a* of the barrier rib 41 from a stacked film of chromium and chromium oxide, or an oxide such as manganese dioxide, copper oxide, etc., the top portion 41*a* having a low reflection coefficient can be realized.

Next, a second function is that a discharge cell selectively reflects light of its emission color or it selectively absorbs lights other than light of its emission color of the cell.

In the plasma panel 20 described with reference to FIG. 1, when at least part of the members configuring the discharge cell thereof, for example, the barrier rib 7, the dielectric 8, and the reflecting layer 11 contain a coloring material, the discharge cell is eventually provided with the second function.

As the coloring material, a material for red (R) configuring three primary colors of RGB is iron oxide, cadmium sulfoselenide, or the like, a material for green (g) is a green pigment of $TiO_2$—CoO—$Al_2O_3$—$Li_2O$ system, inorganic system pigment particles, a pigment of phthalocyanine green system, or the like, and a material for blue (B) is a pigment of cobalt blue system or phthalocyanine system, or the like.

By adding the two functions, the above-described plasma panel achieves both high luminance and high contrast.

EMBODIMENTS

Figure 10:
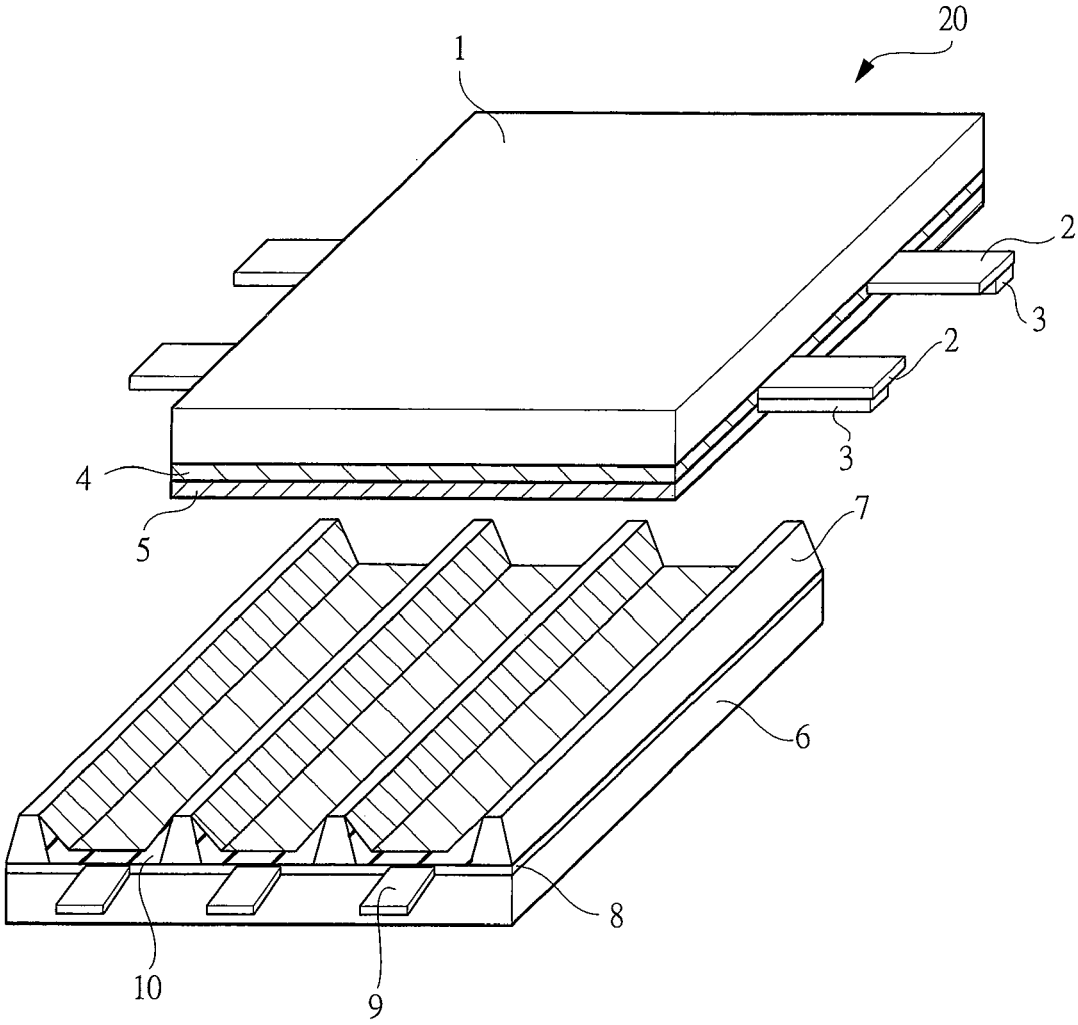
FIG. 10 is an exploded perspective view of a plasma display panel which is an embodiment of the present invention.
Figure 11:
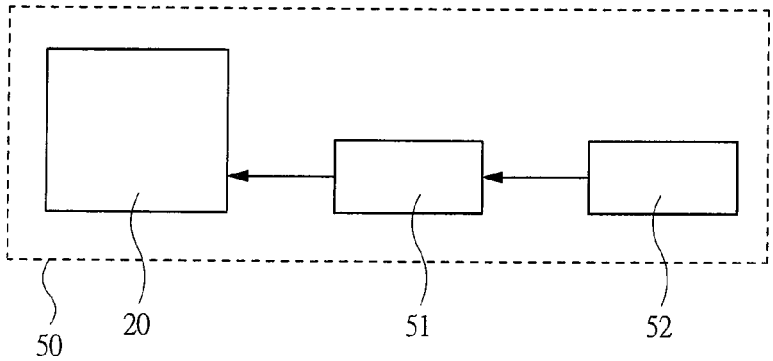
FIG. 11 is a diagram for describing a plasma display apparatus using a plasma display panel.

FIG. 10 is an exploded perspective view of a plasma panel 20, and FIG. 11 is a schematic configuration diagram of a plasma display apparatus 50.

The plasma display apparatus 50 is composed of a plasma panel 20, a driving unit 51 having a driving power source applying voltage to the plasma panel 20, and a video source 52 generating video signals. The plasma panel 20 has a structure where a front substrate 1 and a back substrate 6 are attached to each other, and a plurality of discharge cells are formed between the front substrate 1 and the back substrate 6. Three kinds of electrodes for application of voltage are formed in the discharge cell. Electrode pairs (generally, one electrode of the electrode pair is called "X electrode" and the other is called "Y electrode"), each pair having a transparent electrode 2 for sustain discharge and a bus electrode 3 are formed on the front substrate 1, where the electrode pairs are covered with a dielectric 4 and a protective film 5. On the other hand, address electrodes 9 are formed on the back substrate 6, where the address electrodes 9 are covered with a dielectric 8. Further, barrier ribs (also called "ribs") 7 are configured on the dielectric 8, and a phosphor films 10 of red, blue, green are formed between the barrier ribs 7. As seen in FIG. 10, the barrier rib 7 and the dielectric 8 are directly contacted with the phosphor film 10 and they also have a function as a holding portion (phosphor film holding portion) of the phosphor film 10.

The front substrate 1 and the back substrate 6 are sealed with aligning directions of the front substrate 1 and the back substrate 6 so that sustain discharge pairs on the front substrate 1 side and the address electrodes 9 on the back substrate 6 side are substantially perpendicular to each other (in some cases, simply intersect with each other), and a discharge gas is filled in gap portions between the two substrates, thereby forming the plurality of discharge cells between the two substrates. By selectively applying voltages to the sustain electrode pairs on the front substrate 1 side and the address electrodes 9 on the back substrate 6 side, discharge is caused in a desired discharge cell(s) of the plurality of discharge cells. Vacuum ultraviolet rays are generated by the discharge, and the phosphor films 10 corresponding to the respective colors are excited by the generated vacuum ultraviolet rays, so that emissions of red, blue, and green are generated to perform the full-color display.

Figure 12:
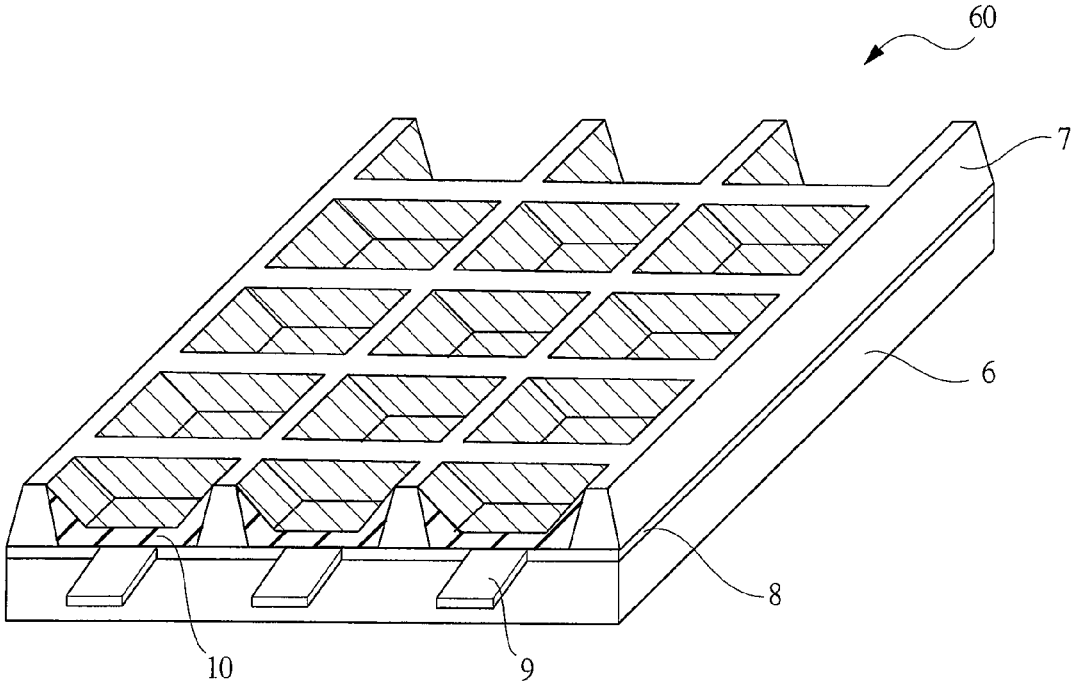
FIG. 12 is an exploded perspective view of a plasma display panel which is an embodiment of the present invention.
Figure 13:
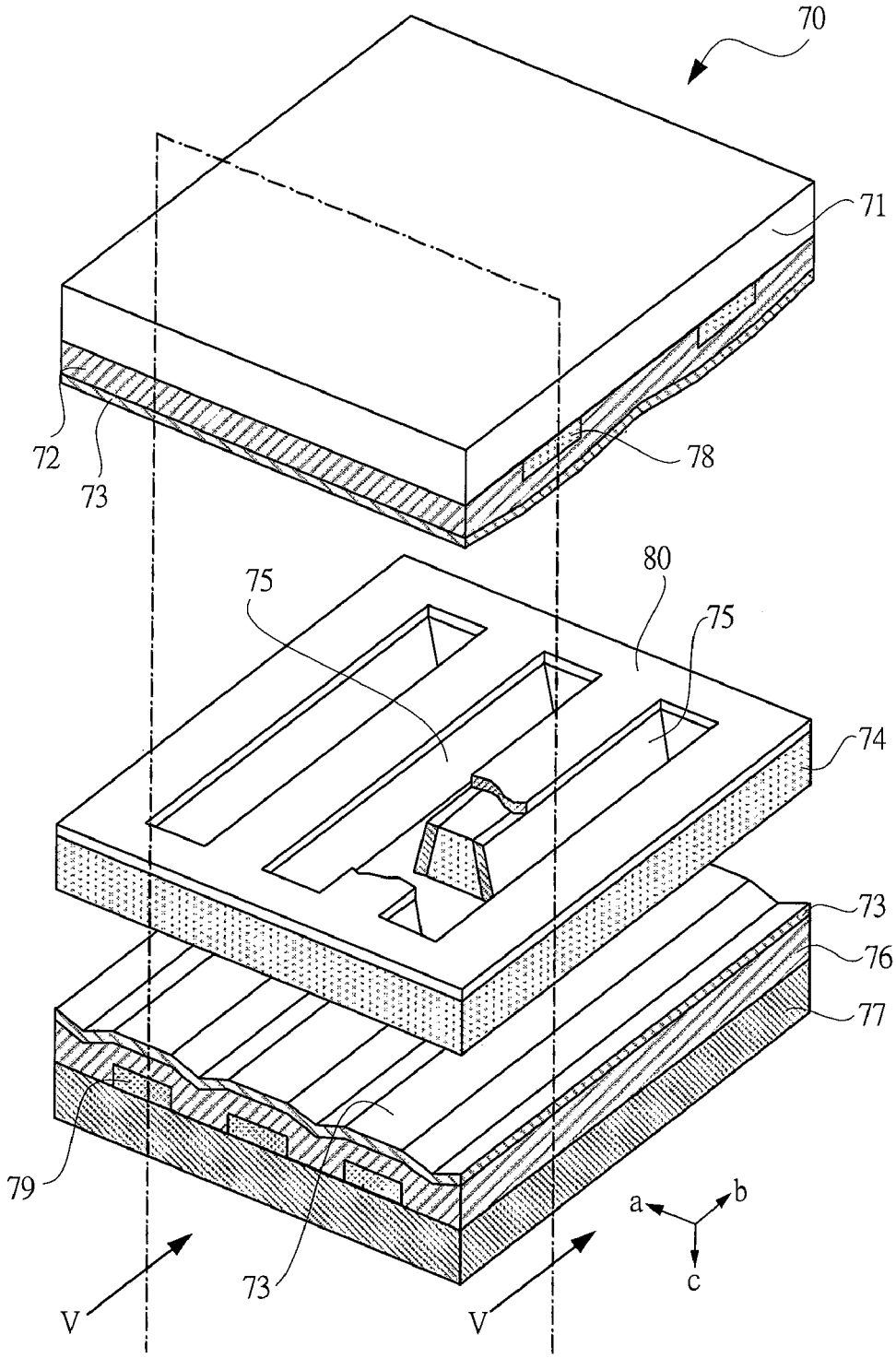
FIG. 13 is an exploded perspective view of a plasma display panel which is an embodiment of the present invention.
Figure 14:
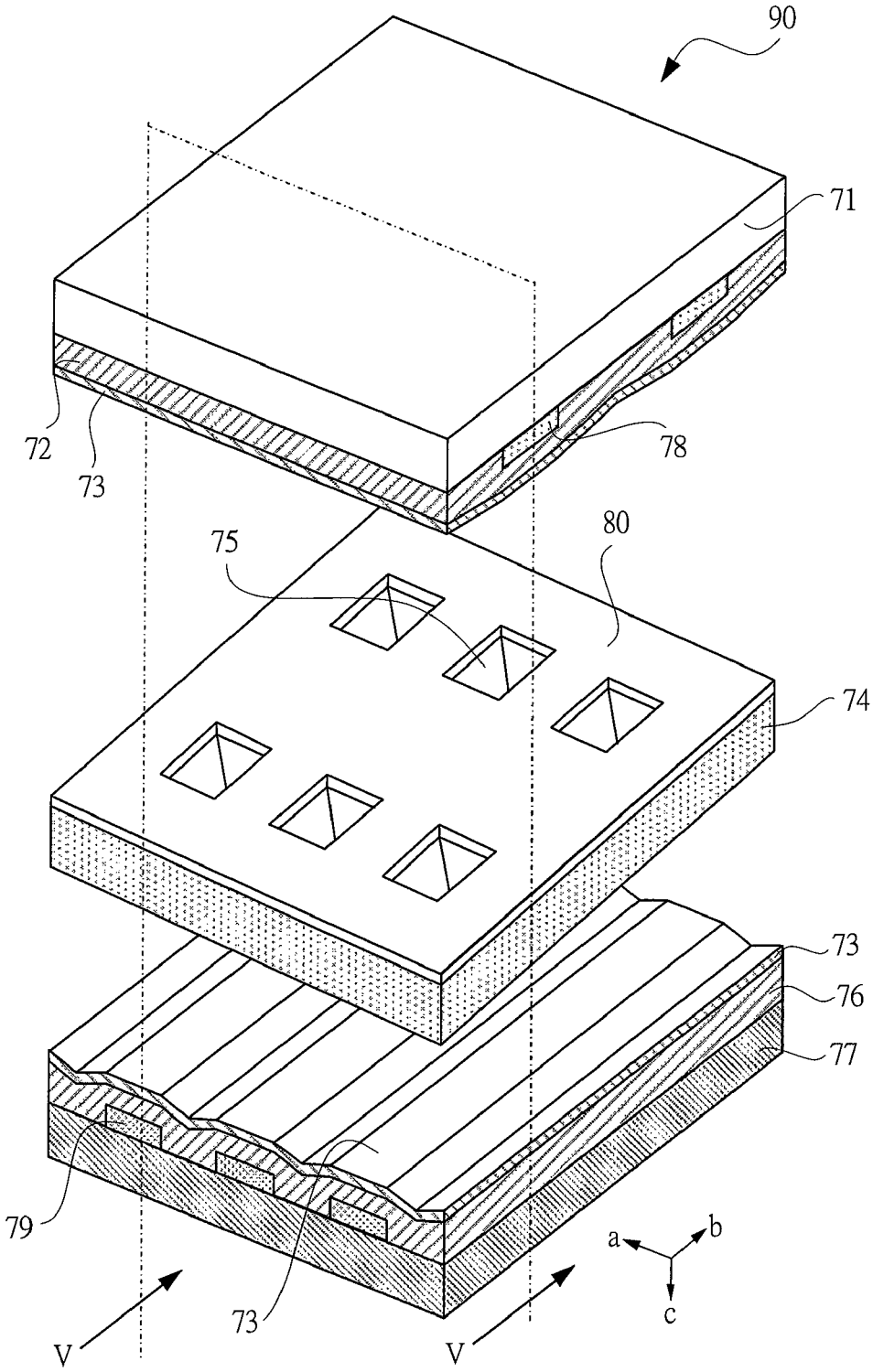
FIG. 14 is an exploded perspective view of a plasma display panel which is an embodiment of the present invention.

The present invention is applied to not only the plasma display apparatus using a three-electrode type plasma panel 20 such as that shown in FIG. 10 but also a plasma display apparatus using a plasma panel 60 having a box-type cell structure on the back substrate 6 side, such as that shown in FIG. 12, a plasma display apparatus using an opposed discharge type plasma display panels 70 and 90 shown in FIG. 13 and FIG. 14, and further, a transmission-type plasma display apparatus, so that effects of high luminance and high contrast can be obtained. Note that, in FIG. 13 and FIG. 14, he reference numeral 71 denotes a front substrate, the reference numeral 72 denotes a dielectric, the reference numeral 73 denotes a protective film, the reference numeral 74 denotes a barrier rib plate, the reference numeral 75 denotes a phosphor film, the reference numeral 76 denotes a dielectric, the reference numeral 77 denotes a back substrate, the reference numeral 78 denotes a scan electrode, the reference numeral 79 denotes a data electrode, and the reference numeral 80 denotes a blackmatrix. In addition, the phosphor film 75 is held by a phosphor film holding portion.

In the following, embodiments will be specifically described. However, the present invention is not limited to the following embodiments but an effect of the present invention can be obtained sufficiently in the region of the film thickness shown in FIG. 6 and FIG. 7 and described previously. Incidentally, an effect in each embodiment will be described with comparing with the performance of the plasma panel 100 which has been explained with reference to FIG. 15, which has been studied by the present inventors.

Embodiment 1

A plasma panel of the present embodiment will be described with reference to FIG. 1. The plasma panel 20 includes the front substrate 1 and the back substrate 6. The transparent electrodes 2, the bus electrodes 3, and the dielectric 4 are provided to the front substrate 1, while the address electrodes 9, the dielectric 8, the barrier ribs 7, and the phosphor films 10 are provided to the back substrate 6. The phosphor film 10 is composed of the phosphor layer 12 and the reflecting layer 11.

In the present embodiment, the reflecting layer 11 made of titanium oxide having a particle diameter dr=1.0 μm is manufactured. The reflecting layer 11 is formed by printing according to the screen printing with mixing the titanium oxide in a paste of binder and solvent. After printed, the binder and solvent are ablated by a drying step and a baking step.

Thereafter, each color phosphor layer 12 is formed by the screen printing method. For example, the film thickness of the reflecting layer 11 after baking was about 12.5 μm, and the film thickness of the phosphor layer 12 was about 12.5 μm that is substantially equal to the film thickness of the reflecting layer 11. The film thickness condition is included in the region 4 shown in FIG. 7.

Then, the plasma panel 20 is manufactured by putting the front substrate 1 and the back substrate 6 on each other to seal them and then charging a discharge gas.

A driving circuit (driving unit) was connected to the plasma panel 20 of the present embodiment and luminance was evaluated. As a result, luminance 1.1 times higher than that of the plasma panel 100 which was studied by the present inventors was achieved.

Embodiment 2

A plasma panel according to the present embodiment will be explained with reference to FIG. 8. In the plasma panel 30, the barrier ribs 31 which are phosphor film holding portions and the dielectric 32 are provided with a reflecting function.

Titanium oxide is mixed in materials used for the barrier ribs 31 and the dielectric 32 in the present embodiment, so that reflection coefficient higher than those of the barrier ribs 107 and the dielectric 108 of the plasma panel 100 which has been studied by the present inventors is obtained. The reflection coefficient of the back substrate 106 of the plasma panel 100 including the barrier ribs 107 and the dielectric 108 was about 20% but the reflection coefficient in the plasma panel 30 according to the present embodiment was 80%.

A driving circuit (driving unit) was connected to the plasma panel 30 of the present embodiment and luminance was evaluated. As a result, luminance 1.1 times higher than that of the plasma panel 100 which was studied by the present inventors was achieved.

Embodiment 3

A plasma panel of the present embodiment will be described with reference to FIG. 9. Such a configuration that, as compared with the plasma panel 20 of the Embodiment 1, a reflection coefficient βt is set to be 5% or less, βt of a surface of the barrier rib 41 that is the phosphor film holding portion except for the surface holding the phosphor 10, that is, βt of a top portion 41*a* of the barrier rib that is not in contact with the phosphor film 10. Thereby, reflection of unnecessary outside light is suppressed, which can result in lowering of black luminance.

Embodiment 4

A plasma panel of the present embodiment will be described with reference to FIG. 1. A feature of the present embodiment lies in that the illustrated discharge cell has a function of selectively reflecting light of emission color of the discharge cell or selectively absorbing light other than light having the emission color of the discharge cell (hereinafter, called "wavelength selecting function"). According to this feature, high luminance and high contrast of the plasma panel 20 can be realized simultaneously.

A contrast Cb of the present embodiment is the so-called bright-room contrast, and is represented by the following expression.

(Mathematical Expression 5)

$$Cb=(Bds+Brf)/Brf \quad \text{(Expression 5)}$$

Here, Brf represents reflected light luminance, namely, luminance formed by room light (outside light) reflected by a display surface of a TV set, and unit thereof is [cd/m$^2$]. In addition, Bds represents display light luminance of the TV set, and unit thereof is [cd/m$^2$].

This reflected light luminance Brf is represented by the following expression.

(Mathematical Expression 6)

$$Brf=Brm\times Rst \quad \text{(Expression 6)}$$

Here, Brm represents the room-light luminance, namely, luminance formed by incidence of room right (outside light) on a surface of a reflection coefficient 1 that is virtually provided to the display surface of the TV set, and unit thereof is [cd/m$^2$]. Rset represents display surface reflection coefficient, namely, reflection coefficient of the display surface of the TV set.

The room-light luminance Brm is represented by the following expression.

(Mathematical Expression 7)

$$Brm=Lrm/\pi \quad \text{(Expression 7)}$$

Here, Lrm represents room-light illumination, and unit thereof is [lx]. The symbol π denotes circle ratio.

In general, since display light luminance Bds>> reflected light luminance Brf, (Expression 5) is represented by the following expression.

(Mathematical Expression 8)

$$Cb\approx Bds/Brf \quad \text{(Expression 8)}$$

It is found from (Expression 8) that the contrast Cb increases according to decrease of the reflected light luminance Brf. Therefore, it is effective that the display surface reflection coefficient Rst is decreased without decreasing the display light luminance Bds. In general, room light (outside light) is white light (mixed color of red (R), green (G), and blue (b)), while display light is monochromatic light for each cell (monochromatic light of either of red (R), green (G), or blue (B)). Therefore, the display surface reflection coefficient Rst can be decreased without decreasing the display light luminance Bds by applying color selectivity (or wavelength selectivity) to reflection characteristics of the cell like the present embodiment. Ideally, it is possible to reduce the display surface reflection coefficient Rst down to about ⅓ (one-third) as a display surface average value without decreasing the display light luminance Bds, and it is possible to increase the bright-room contract up to three times. Thereby, the effects of the present invention can be realized further significantly.

In the present embodiment, a coloring material for selectively reflecting light having an emission color of the cell or selectively absorbing lights other than the light having the emission color of the cell configures at least a part (for example, the barrier rib 7, the dielectric 8) of members configuring the cell. As the coloring material, a material for red (R) configuring three primary colors of RGB is iron oxide, cadmium sulfoselenide, or the like, a material for green (g) is a green pigment of $TiO_2$—CoO—$Al_2O_3$—$Li_2O$ system, inorganic system pigment particles, a pigment of phthalocyanine green system, or the like, and a material for blue (B) is a pigment of cobalt blue system or phthalocyanine system, or the like.

In addition, the reflecting layer 11 may be formed of a member containing a coloring material. Fine particles of the coloring material can be adhered to a surface of reflecting material particles contained in the reflecting layer 11. Alternatively, surfaces of reflecting material particles contained in the reflecting layer 11 can be coated (covered) with the coloring material itself.

Further, by using a material having a predetermined reflective index and a predetermined thickness (hereinafter, called "interfering material") instead of the coloring material, it can be realized that light having an emission color of the cell can be selectively reflected or lights other than the light having the emission color of the cell can be selectively absorbed by interference of light. For example, the interfering material can be formed by stacking a thin film of a high refractive index material such as zinc sulfide ZnS and a thin film of a low refractive index material such as cryolite $Na_3AlF_6$ alternately.

In the present embodiment, the emission function is composed to be separated from the phosphor layer 12, and the reflecting function is composed to be separated from the reflecting layer 11. Therefore, the wavelength selecting function can be provided only on the reflecting layer 11. As a result, wavelength selection of reflected light can be realized without impairing the emission function.

Accordingly, it is possible to highly realize high luminance and high contrast of the plasma panel 20 simultaneously.

Embodiment 5

A plasma panel of the present embodiment will be described with reference to FIG. 8. A feature of the present embodiment lies in that the illustrated discharge cell has a function of selectively reflecting light having an emission color of the discharge cell or selectively absorbing lights other than the light having the emission color of the discharge cell (hereinafter, called "wavelength selecting function"). According to this feature, high luminance and high contrast of the plasma panel 30 can be realized simultaneously. The mechanism is the same as that of the above-described Embodiment 4. The configuration of the present embodiment is substantially the same as that of the above-described Embodiment 4. A difference therebetween lies in that a member containing the coloring material serving as the wavelength selecting function or the member containing interfering material is used in the phosphor film holding portion (at least one of the barrier rib 31 and the dielectric 32).

As described above, the phosphor film has two functions, namely, the emission function of converting ultraviolet light to visible rays to emit the same and a reflecting function for radiating the visible rays towards the front surface of the panel.

For example, in a phosphor film 110 having a one-layer structure such as that of the plasma panel 100 (see FIG. 15) which has been examined by the inventors, the phosphor film 110 simultaneously serves as the luminescence function and the reflecting function. When addition of the wavelength selecting function is desired, the wavelength selecting function must be provided to the phosphor film 110 necessarily. As a result, such a problem arises that the coloring material or the interfering material configuring the wavelength selecting function absorbs part of ultraviolet light, which results in lowering of the emission function of the phosphor film 110.

On the other hand, in the present embodiment, the emission function is configured to be separated from the phosphor film 10 and the reflecting function is configured to be separated from the phosphor film holding portion. Therefore, the wavelength selecting function can be provided only in the phosphor film holding portion. As a result, wavelength selection of reflected light can be realized without impairing the emission function.

Accordingly, it is possible to highly realize high luminance and high contrast of the plasma panel 30 simultaneously.

While the invention made by the inventors of the present invention has been concretely described based on the embodiments in the foregoing, it is needless to say that the present invention is not limited to the foregoing embodiments and various modifications and alterations can be made within the scope of the present invention.

INDUSTRIAL APPLICABILITY

The present invention is widely utilized in the manufacturing industry for manufacturing plasma display panels.

The invention claimed is:

1. A plasma display panel comprising:

a plurality of discharge cells, with one or more of the discharge cells including:

a plurality of electrodes for applying a voltage to the discharge cell;

a discharge gas for forming a discharge;

a discharge space in which the discharge is formed; and a phosphor film emitting visible rays by excitation caused by ultraviolet light generated by the discharge, wherein the phosphor film includes at least two layers of a phosphor layer and a reflecting layer, the phosphor layer disposed closer to the discharge space side than the reflecting layer, wherein the reflecting layer reflects at least visible rays, wherein a thickness of the phosphor film, namely, a phosphor film thickness Wt is 40 μm or less, and a thickness of the phosphor layer, namely, a phosphor layer thickness Wp, a particle diameter of a phosphor that is at least a part of the phosphor layer, namely, a phosphor particle diameter dp, a thickness of the reflecting layer, namely, a reflecting layer thickness Wr, and a particle diameter of a reflecting material that is at least a part of the reflecting layer, namely, a reflecting material particle diameter dr satisfy the relationships $2dp \leqq Wp \leqq 5dp$ and $2dr \leqq Wr \leqq Wt - Wp$, and wherein a material forming the phosphor layer and a material forming the reflecting layer have different compositions from each other.

2. The plasma display panel according to claim 1, wherein the phosphor film thickness Wt is 25 μm or less.

3. The plasma display panel according to claim 1, wherein the phosphor film thickness Wt is 15 μm or less.

4. The plasma display panel according to claim 1, wherein the phosphor particle diameter dp is in a range of 2 μm to 7 μm.

5. The plasma display panel according to claim 1, wherein the phosphor particle diameter dp is in a range of 3 μm to 5 μm.

6. The plasma display panel according to claim 1, wherein the reflecting material particle diameter dr is in a range of 0.5 μm to 4 μm.

7. The plasma display panel according to claim 1, wherein the phosphor layer thickness Wp is in a range of 6 μm to 15 μm.

8. The plasma display panel according to claim 1, wherein the reflecting layer thickness Wr is in a range of 7 μm to 20 μm.

9. The plasma display panel according to claim 1, wherein the reflecting layer thickness Wr is in a range of 10 μm to 15 μm.

10. The plasma display panel according to claim 1, wherein a reflection coefficient of visible rays of the reflecting layer is 70% or more.

11. The plasma display panel according to claim 1, wherein a reflection coefficient of visible rays of the reflecting layer is 85% or more.

12. The plasma display panel according to claim 1, wherein a coloring material having a function of selectively reflecting light having an emission color of the phosphor film or selectively absorbing light except for the light having the emission color of the phosphor film is contained in the reflecting layer.

13. A plasma display panel comprising:

a plurality of discharge cells with one or more of the discharge cells including:

a plurality of electrodes for applying a voltage to the discharge cell;

a discharge gas for forming a discharge;

a discharge space in which the discharge is formed;

a phosphor film emitting visible rays according to excitation caused by ultraviolet light generated by the discharge; and a phosphor film holding portion disposed to hold the phosphor film, wherein a thickness of the phosphor film, namely, phosphor film thickness Wt, a particle diameter of phosphor which is at least a part of the phosphor layer, namely, a phosphor particle diameter dp, and a reflection coefficient of visible rays βs of at least a part of a surface holding the phosphor film of the phosphor film holding portion satisfy the relationships $2dp \leqq Wt \leqq 5dp$ and $0.70 \leqq \beta s$.

14. The plasma display panel according to claim 13, wherein the phosphor particle diameter dp is in a range of 2 μm to 7 μm.

15. The plasma display panel according to claim 13, wherein the phosphor particle diameter dp is in a range of 3 μm to 5 μm.

16. The plasma display panel according to claim 13, wherein the reflection coefficient of visible rays βs of at least a part of the surface holding the phosphor film of the phosphor film holding portion is 85% or more.

17. The plasma display panel according to claim 13, wherein the phosphor film holding portion is a dielectric of a barrier rib and a back substrate.

18. The plasma display panel according to claim 17, wherein a reflection coefficient of visible rays βt of a surface of the barrier rib except for the surface of the same holding the phosphor film, namely, a surface of a top portion of the barrier rib is 5% or less.

19. The plasma display panel according to claim 13, wherein a coloring material having a function of selectively reflecting light having an emission color of the phosphor film or selectively absorbing light except for the light having the emission color of the phosphor film is contained in the phosphor film holding portion.

20. A plasma display apparatus comprising:

a plasma display panel and a driving unit for applying a voltage to the plasma display panel, wherein the plasma display panel includes at least a plurality of discharge cells, with one or more of the discharge cells including:

a plurality of electrodes for applying the voltage to the discharge cell;

a discharge gas for forming a discharge;

a discharge space in which the discharge is formed; and a phosphor film emitting visible rays by excitation caused by ultraviolet light generated by the discharge, wherein the phosphor film includes at least two layers of a phosphor layer and a reflecting layer, the phosphor layer being disposed closer to the side of the discharge space than the reflecting layer, wherein the reflecting layer reflects at least visible rays, and a phosphor film holding portion is disposed to hold the phosphor film, wherein a thickness of the phosphor film, namely, a phosphor film thickness Wt is 40 μm or less, and a thickness of the phosphor layer, namely, a phosphor layer thickness Wp, a particle diameter of a phosphor which is at least a part of the phosphor layer, namely, a phosphor particle diameter dp, a thickness of the reflecting layer, namely, a reflecting layer thickness Wr, and a particle diameter of a reflecting material which is at least a part of the reflecting layer, namely, a reflecting material particle diameter dr satisfy the relationships $2dp \leqq Wp \leqq 5dp$ and $2dr \leqq Wr \leqq Wt - Wp$, and wherein a material forming the phosphor layer and a material forming the reflecting layer have different compositions from each other.

* * * * *